US009017006B2

(12) United States Patent
Huissoon

(10) Patent No.: US 9,017,006 B2
(45) Date of Patent: Apr. 28, 2015

(54) MOBILE DEVICE

(75) Inventor: Leendert Wilhelmus Cornelis Huissoon, Zeekland (NL)

(73) Assignee: Hudsin Bay Holding B.V., 's-Heer Arendskerke (NL)

( * ) Notice: Subject to any disclaimer, the term of this patent is extended or adjusted under 35 U.S.C. 154(b) by 663 days.

(21) Appl. No.: 13/002,495

(22) PCT Filed: Jul. 13, 2009

(86) PCT No.: PCT/NL2009/050424

§ 371 (c)(1),
(2), (4) Date: Mar. 7, 2011

(87) PCT Pub. No.: WO2010/008277

PCT Pub. Date: Jan. 21, 2010

(65) Prior Publication Data

US 2011/0176899 A1 Jul. 21, 2011

(30) Foreign Application Priority Data

Jul. 14, 2008 (NL) ..... 1035694
Oct. 22, 2008 (NL) ..... 2002125

(51) Int. Cl.

| | |
|---|---|
| ***E02F 3/84*** | (2006.01) |
| ***E02F 3/96*** | (2006.01) |
| ***E02F 3/30*** | (2006.01) |
| ***E02F 3/36*** | (2006.01) |
| ***E02F 9/08*** | (2006.01) |

(52) U.S. Cl.

CPC ..... *E02F 3/964* (2013.01); *E02F 3/301* (2013.01); *E02F 3/3609* (2013.01); *E02F 9/085* (2013.01)

(58) Field of Classification Search

CPC ..... E02F 3/301; E02F 3/3609; E02F 3/3663; E02F 3/384; E02F 3/42; E02F 3/964; E02F 9/121; E02F 9/166; E02F 9/085

USPC ..... 414/687, 694, 695.5, 699, 700, 703, 414/722, 723; 701/50; 180/89.12, 89.13

See application file for complete search history.

(56) References Cited

U.S. PATENT DOCUMENTS 3,703,973 A * 11/1972 Nilsson ..... 414/715
4,737,067 A * 4/1988 Samejima et al. ..... 414/686

(Continued)

FOREIGN PATENT DOCUMENTS

DE 3932555 4/1991
EP 0150154 7/1985

(Continued)

*Primary Examiner* — Dean Kramer

(74) *Attorney, Agent, or Firm* — Daniel G. Stoddard; Bret E. Field; Bozicevic, Field & Francis LLP

(57) ABSTRACT

Mobile apparatus, comprising a main frame (202) displaceable on displacing means; a sub-frame (203) which is rotatable around a vertical axis and which is mounted on the main frame and provided with a control unit; at least one operating arm (210) mounted on the sub-frame and an automatically movable lifting device provided on the main frame, which lifting device is adapted to be connectable to an agricultural attachment.

18 Claims, 34 Drawing Sheets

(56) References Cited

U.S. PATENT DOCUMENTS

| | | | | |
|---|---|---|---|---|
| 4,950,127 | A * | 8/1990 | Weyer | 414/694 |
| 5,265,995 | A | 11/1993 | Beck | |
| 5,367,796 | A | 11/1994 | Bowers et al. | |
| 5,727,921 | A * | 3/1998 | Brown | 414/694 |
| 6,409,457 | B1 * | 6/2002 | Korycan et al. | 414/501 |
| 6,769,860 | B2 * | 8/2004 | Yoshii et al. | 414/686 |
| 6,772,544 | B2 * | 8/2004 | Takemura et al. | 37/347 |
| 6,776,571 | B2 * | 8/2004 | Riffle | 414/722 |
| 2003/0204297 | A1 * | 10/2003 | Griffith et al. | 701/50 |

FOREIGN PATENT DOCUMENTS

| | | |
|---|---|---|
| EP | 1364572 | 11/2003 |
| EP | 1472416 | 11/2004 |
| EP | 1507043 | 2/2005 |
| JP | 9158236 | 6/1997 |
| NL | 1028661 | 10/2006 |
| WO | 8911006 | 11/1989 |
| WO | 2007064700 | 6/2007 |

* cited by examiner

MOBILE DEVICE

The present invention relates to a mobile apparatus for use in agriculture, forestry, in earth-moving and other operations such as pulling and driving farm machinery, digging and loading, lifting and displacing loads and so on. The present invention relates more particularly to a mobile apparatus which can perform more of these tasks, optionally simultaneously.

Known from the prior art are tractors which are typically provided with a three-point mounting for mounting a plough or other attachments thereon. Further known are so-called backhoe loaders which provide an excavator-loader combination on wheels. A backhoe loader is a vehicle similar to a tractor and having at the rear a digging arm and at the front a loading bucket. Finally, numerous excavators are known in which a digging arm is mounted on a rotatable sub-frame of the excavator.

The present invention has for its object to provide a mobile apparatus of the type stated in the preamble which allows more of the above stated tasks to be performed, optionally simultaneously, in practical manner using one and the same mobile apparatus.

The present invention is distinguished for this purpose in that the mobile apparatus comprises:

- a main frame displaceable on displacing means;
- a sub-frame which is rotatable around a vertical axis and which is mounted on the main frame and provided with a control unit;
- at least one operating arm mounted on this sub-frame; and
- an automatically movable lifting device provided on the main frame, which lifting device is adapted to be connectable to an agricultural attachment. The lifting device is preferably a three-point lifting device.

The mobile apparatus can in this way be used for normal agricultural activities wherein a suitable agricultural attachment can be coupled to the lifting device while the operating arm mounted on the sub-frame can be used, optionally simultaneously, for other operations, typically digging/loading operations.

The multifunctional tractors of the prior art do not have a rotatable sub-frame and the operating arm must typically be uncoupled before an attachment coupled to the three-point lifting device can be used. This problem is solved by the invention by mounting the operating arm on a rotatable sub-frame while the lifting device is provided on the main frame.

The term "three-point lifting device" must be understood to mean a usual three-point lifting device as known on tractors, this three-point lifting device also been referred to with the terms three-point suspension or three-point coupling.

According to the preferred embodiment, the at least one operating arm comprises an articulated operating arm, and in particular a digging arm on the outer end of which an attachment can be mounted. The articulated operating arm more preferably consists of at least three articulations connected pivotally to each other, wherein the last articulation of the operating arm has a greater length than the penultimate one such that the articulations can be folded against each other, and the arm can be transformed from an articulated arm to a single lifting arm. Such embodiments are described in detail in the European patent EP 1 472 416 in the name of applicant, the text of which is incorporated herein by reference.

Other possible embodiments of the articulated arm are described in the European patents EP 1 245 739, EP 0 740 023 and EP 1 818 460 in the name of the Group Mecalac, and in the French patent FR 2 727 998, likewise in the name of Mecalac.

According to another possible embodiment, the at least one operating arm comprises a lifting arm, for instance a single or stereo/double arm. The at least one operating arm can further take a telescopic form.

According to a further aspect of the invention, the at least one operating arm can be mounted on the sub-frame for pivoting around a horizontal axis and/or a vertical axis. Such an assembly is likewise described in the above stated patent in the name of applicant, see in particular FIG. 4 and the related description.

According to the preferred embodiment, the mobile apparatus is a tractor. Within the scope of the present invention the term "tractor" must be interpreted broadly as a vehicle which can pull, push or tow something not having a drive of its own. Although the displacing means of a tractor are typically wheels, it is also possible in respect of the present invention to envisage caterpillar tracks or mechanical legs.

The mobile apparatus typically comprises one or more motors for driving the displacing means, the at least one operating arm and the lifting device. Examples of possible drive means are: petrol, diesel, biodiesel, ethanol, LPG, natural gas, hydrogen or electric motors; fuel cells, batteries etc., or a combination thereof. In the case of an embodiment with wheels, these can be steerable and/or driven. According to a possible embodiment, only a number of the wheels are steered and/or driven.

According to yet another aspect, the main frame can have a so-called articulated steering which is typical for tractors, wheel loaders and loading buckets used in forestry or road construction. With an articulated steering a mobile apparatus can rotate in the middle, whereby it is possible to negotiate very tight bends. The rotation is made possible by a vertical or substantially vertical axis usually positioned between the axes of the wheels/caterpillar tracks. Four-wheel steering is also possible.

In the case of a caterpillar track drive, the invention comprises embodiments with two caterpillar tracks, but also embodiments with a plurality of caterpillar tracks, wherein for instance in an embodiment with wheels each of the wheels is replaced by a caterpillar track.

According to preferred embodiment, the drive means are mounted in the sub-frame. In the case of a motor, the motor will typically be mounted at the bottom of the sub-frame, while the fuel tank connected thereto can be mounted in the sub-frame or in the main frame.

According to a possible embodiment, the motor is mounted centrally at the rear of the sub-frame and a tank is mounted on either side thereof, which tank can be intended for fuel, hydraulic oil or any other liquid or gas necessary for driving. Other variants will be discussed hereinbelow with reference to the figures.

According to preferred embodiment of the invention, a feed for liquid and/or gas and/or electricity rotatable through 360° is provided between the rotatably mounted sub-frame and the main frame such that the lifting device, the displacing means and optional other components can be provided with the necessary energy. This energy can also be supplied to the different attachments via couplings close to the lifting device, often at the rear of the main frame or the sub-frame, although the front side is also an option.

The sub-frame is preferably provided with a driver's seat situated substantially in the centre, i.e. at half the width of the machine. In this way an operator will have a good view of the operations performed by the at least one operating arm. According to another possibility, the position of the operator can also be placed out of the centre, see for instance the embodiments described in the above stated patent in the name of applicant. The skilled person will appreciate that embodiments can likewise be envisaged without operator, wherein the mobile apparatus is remotely controlled.

According to a possible embodiment, the at least one operating arm is actuated as described in the Netherlands patent NL 1 028 661 in the name of applicant. The skilled person will once again appreciate that numerous other actuations are possible in accordance with the embodiment of the at least one operating arm.

In the case of a sub-frame with driver's seat, this can be embodied optionally with rollover protection, with a cab, with a fold-away or partially fold-away cab or with a convertible cab.

According to the preferred embodiment of the invention, the main frame is further provided with one or more stabilizers such as jacks for the purpose of stabilizing the apparatus during specific operations, and in particular during the use of the at least one operating arm. According to one option, two stabilizers are provided at the rear which can be actuated via one or more actuating members such as hydraulic cylinders.

According to a further developed embodiment, the stabilizers and the lifting device are combined, preferably at the rear, wherein for instance a shared actuation is provided for the lifting device and the one or more stabilizers. The stabilizers are preferably removable, this such that the stabilizer can be removed or can be made more compact, and so leave space for agricultural attachments coupled to the lifting device.

An embodiment of the mobile apparatus can further be embodied with one or more stabilizers on the front side. According to a possible embodiment, a stabilizing element is provided on the front side which can be connected to an attachment, typically a loading bucket, which attachment can in this way function as stabilizing means, particularly on a soft ground surface.

According to yet another variant, a stabilizer can be formed by coupling an attachment such as a loading bucket to a quick change system connected to the main frame, this such that the quick change system with attachment forms a stabilizing platform. Such a quick change system can be of the same type as the system used on the outer end of operating arms for the purpose of coupling a digging or loading attachment thereto. It is also possible to use an adapter or quick change system of the skid steer of bobcat type, for instance in accordance with the SAE J 2513 norm.

According to the preferred embodiment of the mobile apparatus, the centre of gravity of the displaceable main frame lies lower than the top side of the displacing means, and the sub-frame has an underside with a recess, the form of which is adapted to extend over the displacing means, this such that the lowest point of the sub-frame lies lower than the top side of the displacing means and that the sub-frame can rotate freely without making contact with the displacing means. Such a design results in a stable mobile apparatus in which the rotatable sub-frame lies as low as possible, this in contrast to the prior art digging machines in which the rotatable sub-frame typically lies higher than the displacing means.

According to the embodiment in the form of a typical tractor with rear wheels which are larger than the front wheels, the main frame is preferably situated substantially between the front and rear wheels and the sub-frame has an underside with a recess, the form of which is adapted to extend over the rear wheels. The rotatable sub-frame will typically be embodied with a counterweight which can play a part as integrated wing or can function as a body in which a tank or a battery can be accommodated.

According to a further developed embodiment, the at least one operating arm is provided with a guiding adapted to move the attachment over a surface for working. In this way a loading bucket can follow the contours of the ground surface, this resulting in a tidy, smooth and efficient working.

It is further recommended to block the sub-frame relative to the main frame in specific situations, for instance:

- in an operative position of the at least one operating arm, typically a digging or load bucket position in the case of a digging/loading operating arm;
- in a situation wherein the operating arm threatens to rotate against a part of the main frame or the displacing means (in another variant the operating arm is automatically moved upward).

According to a further aspect of the invention, a control system can be provided for automatically guiding the rotation of the sub-frame and/or the movement of the at least one operating arm as a function of the steering of the displacing means. In this way the operating arm can for instance be placed automatically in the same direction as the travel direction. According to a further developed embodiment, the angle which the operating arm makes can be the same as the steering wheel movement, or be proportional to the steering wheel movement optionally as a function of the travel speed of the machine.

According to an embodiment, the mobile apparatus is provided on a front side with a pair of front wheels and on a rear side with a pair of rear wheels, wherein the front wheels are larger than or as large as the rear wheels.

According to an embodiment, the lifting device is provided on the front side or on the rear side, or on both the front side and the rear side.

According to an embodiment, the rear side is provided with a coupling system to which a counterweight, in particular a loading bucket, can be coupled.

According to an embodiment, the apparatus has a front side and rear side and a travel direction corresponding thereto, wherein the travel direction, and therefore also the front and rear sides, are reversible.

According to an embodiment, a switch which can be operated by a driver is provided for adjusting the travel direction.

According to an embodiment, the mobile apparatus is provided with steering means, such as a steering wheel or a joystick, wherein a signal manipulator such as a relay is further provided, which signal manipulator is coupled to the switch and to the steering means for controlling a steering member for moving the mobile apparatus in the travel direction set by the driver using the switch.

According to an embodiment, the mobile apparatus is provided with a forward/reverse switch, wherein the forward/reverse switch is likewise coupled to the signal manipulator for controlling the steering member for moving the mobile apparatus in the travel direction set by the driver using the switch, taking into account the position of the forward/reverse switch.

According to an embodiment, an additional attachment such as a mowing bar is mounted under the main frame.

According to an embodiment, the front and rear wheels operate at a different track width.

According to an embodiment, the track width of the wheels is adjustable and means for adjusting the track width are provided which can be operated by a driver.

According to an embodiment, braking and/or locking means are provided for limiting and/or locking the movement of the sub-frame relative to the main frame.

The present invention will be further elucidated on the basis of a number of non-limitative exemplary embodiments with reference to the accompanying drawing, in which.

Figure 20B:
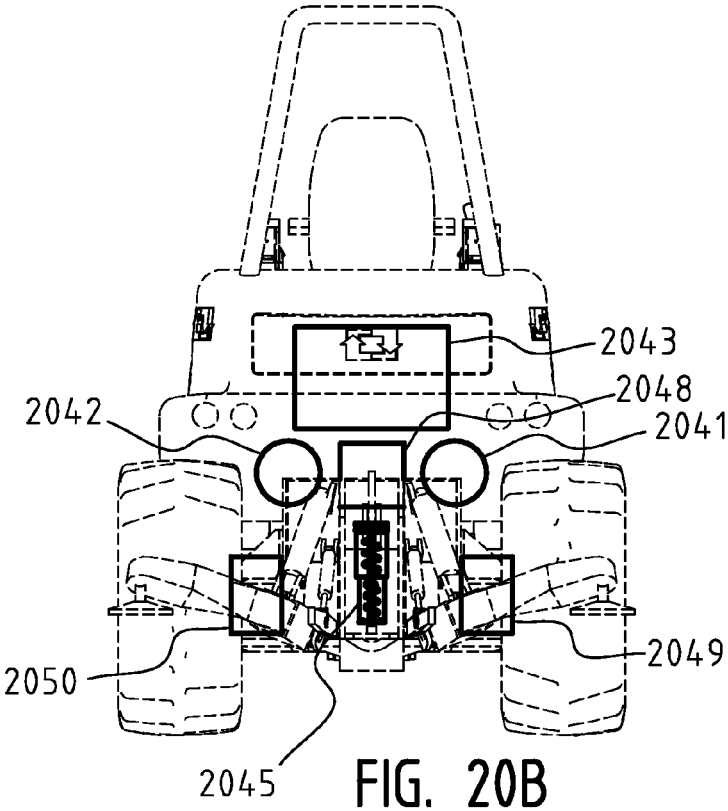
Figure 6A:
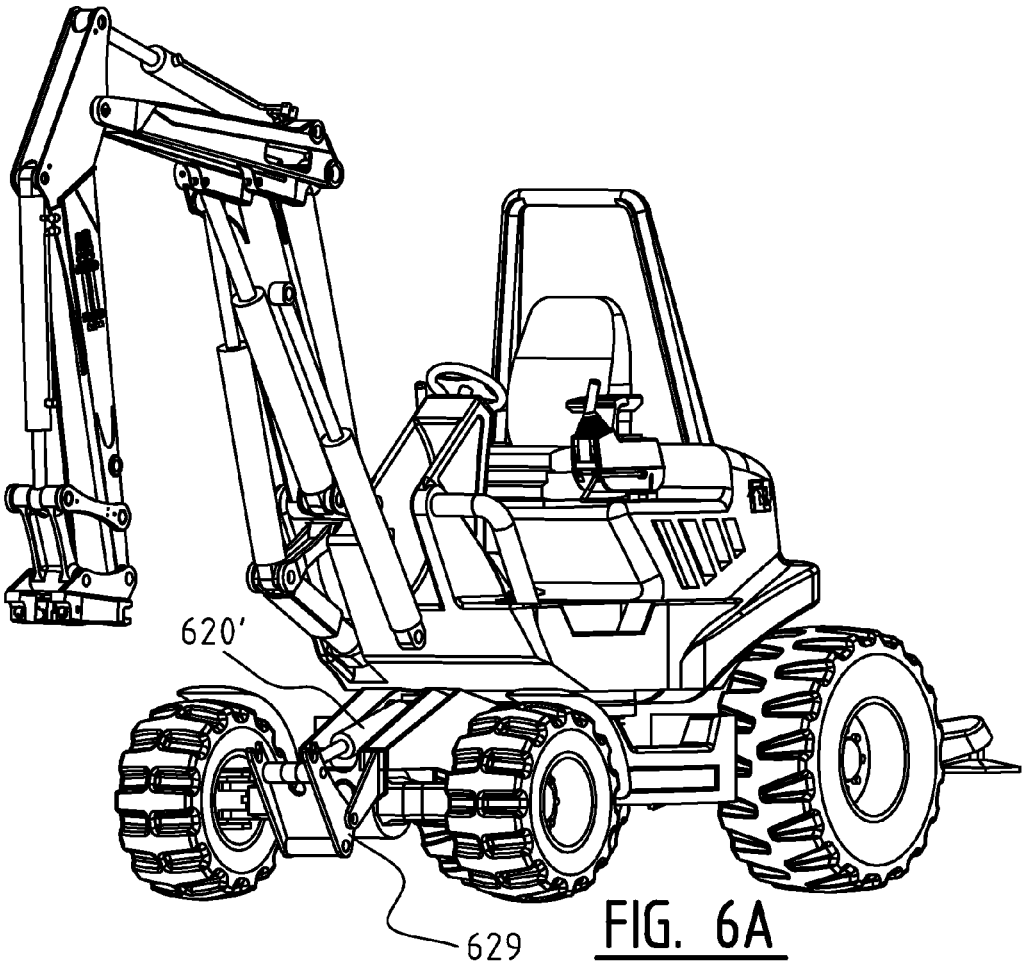
Figure 6B:
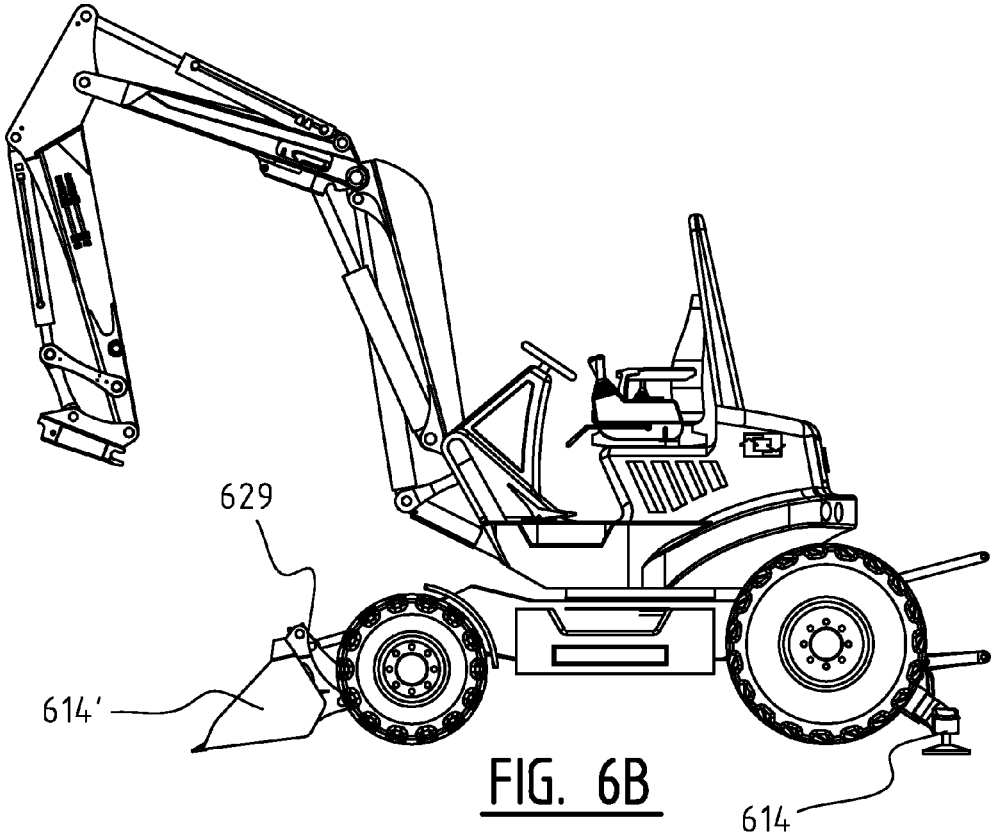
Figure 6C:
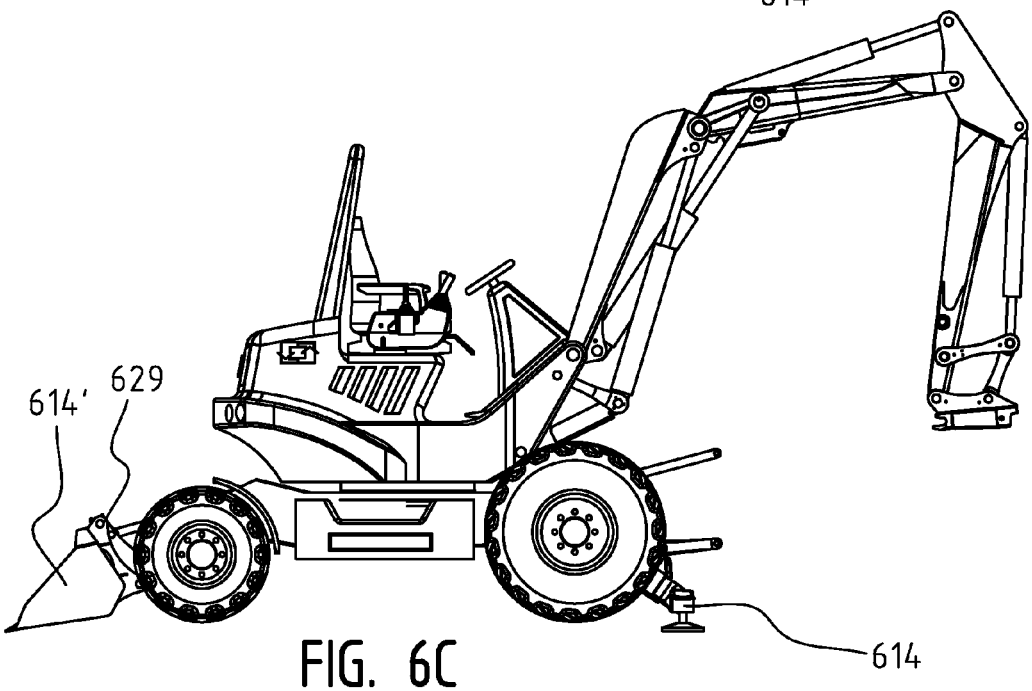
Figure 7:
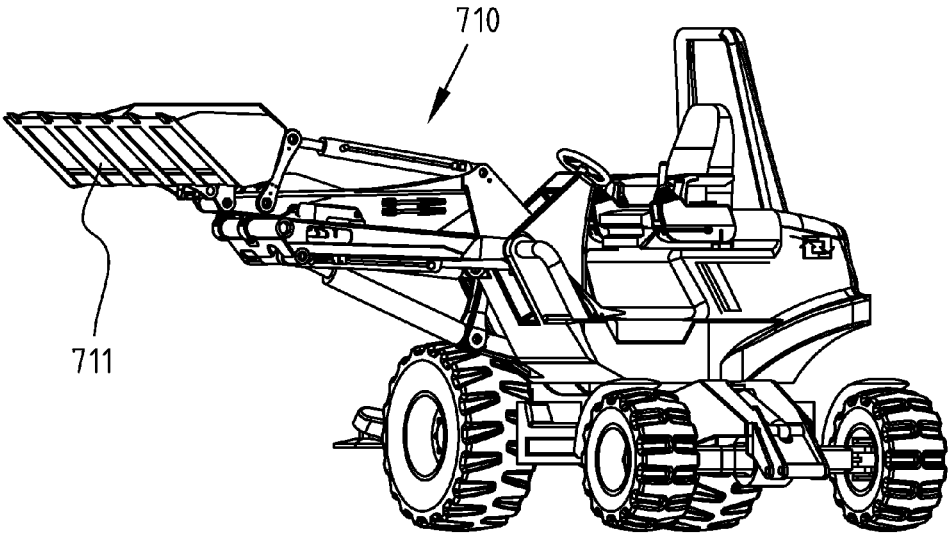
Figure 8:
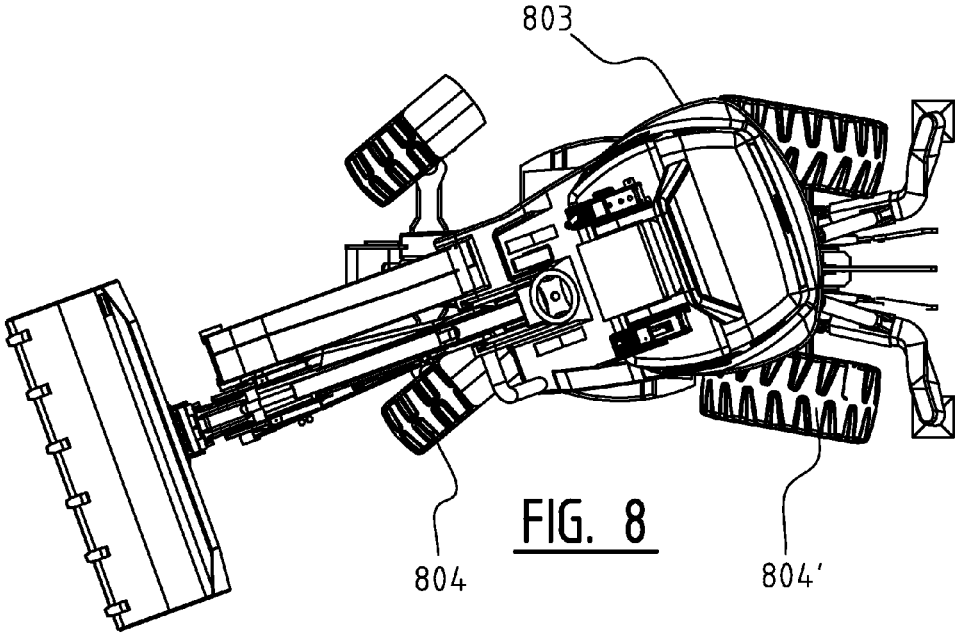
Figure 9A:
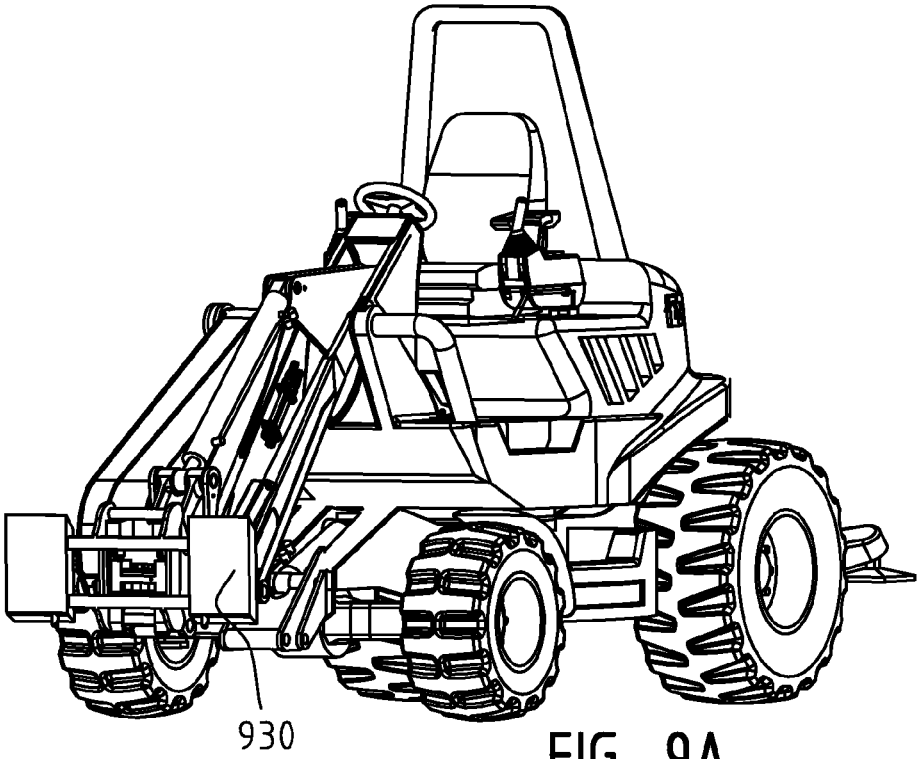
Figure 10:
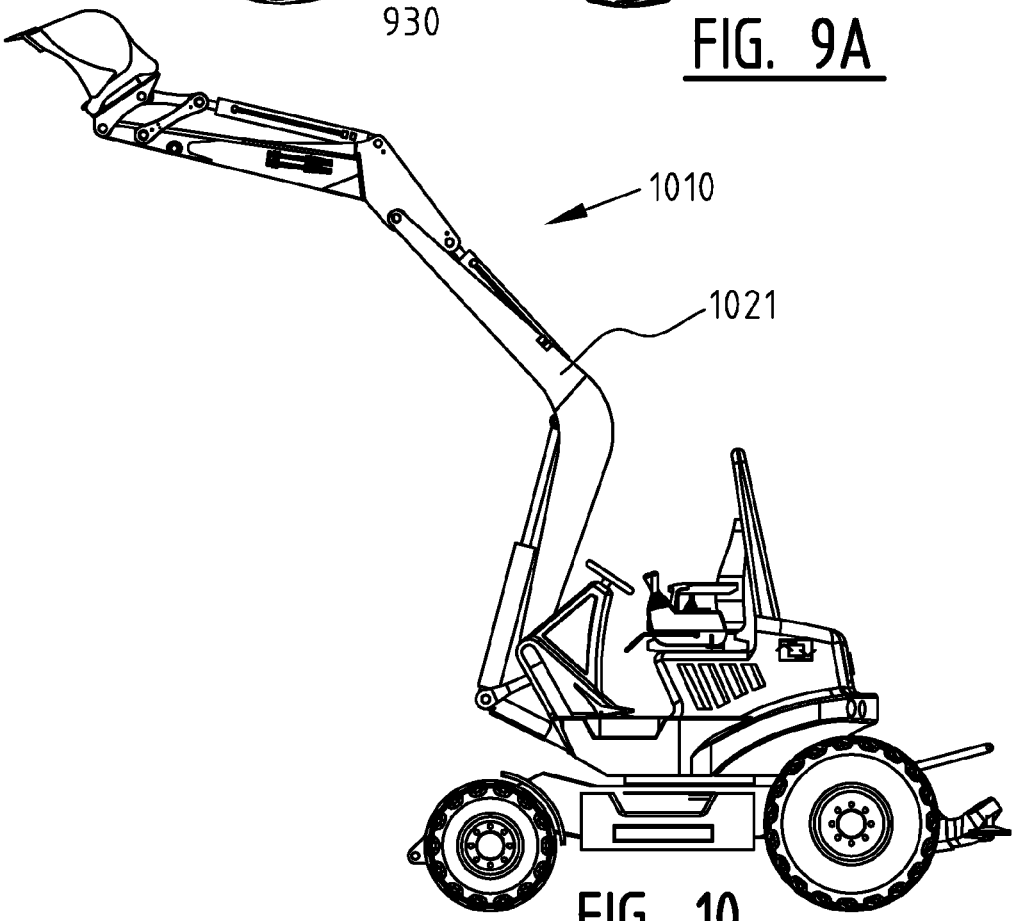
Figure 9B:
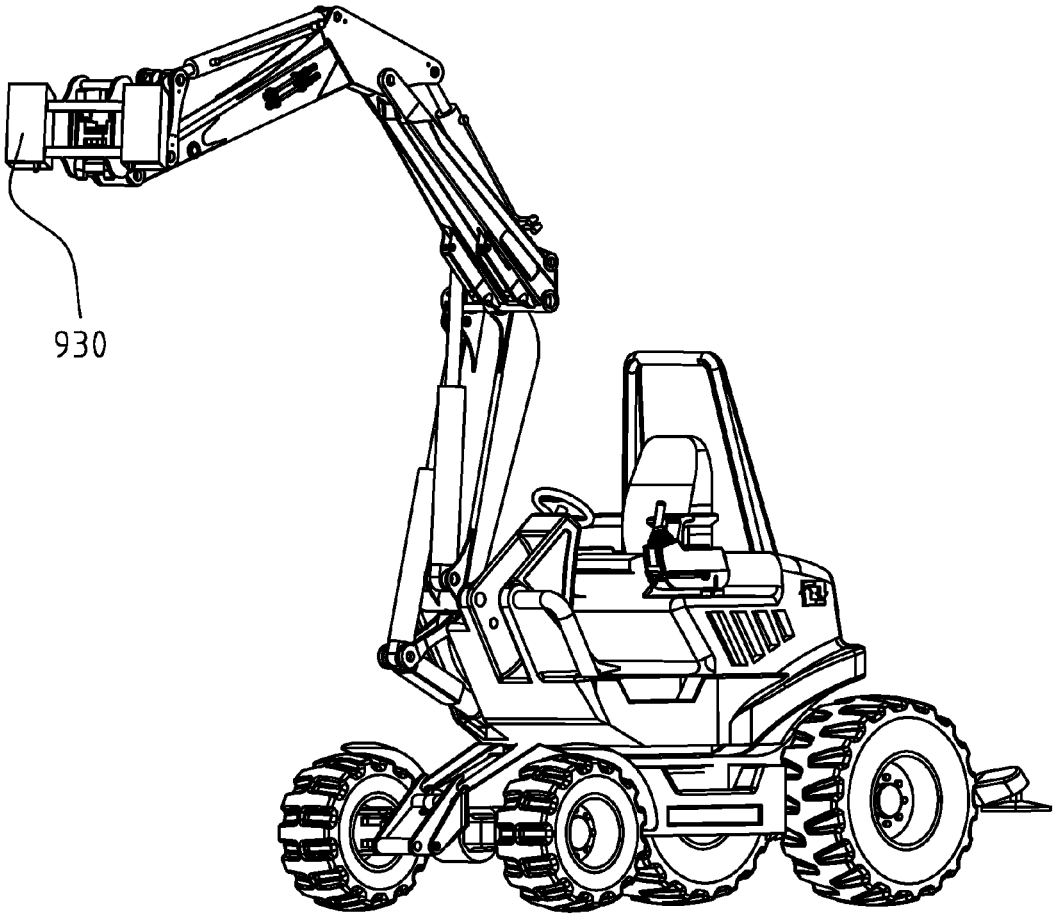
Figure 11A:
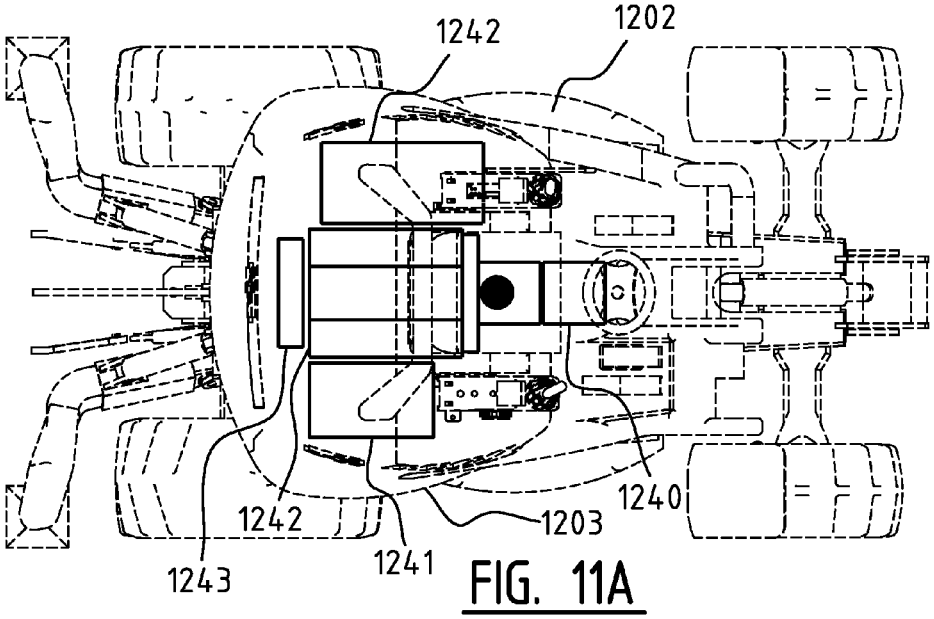
Figure 11B:
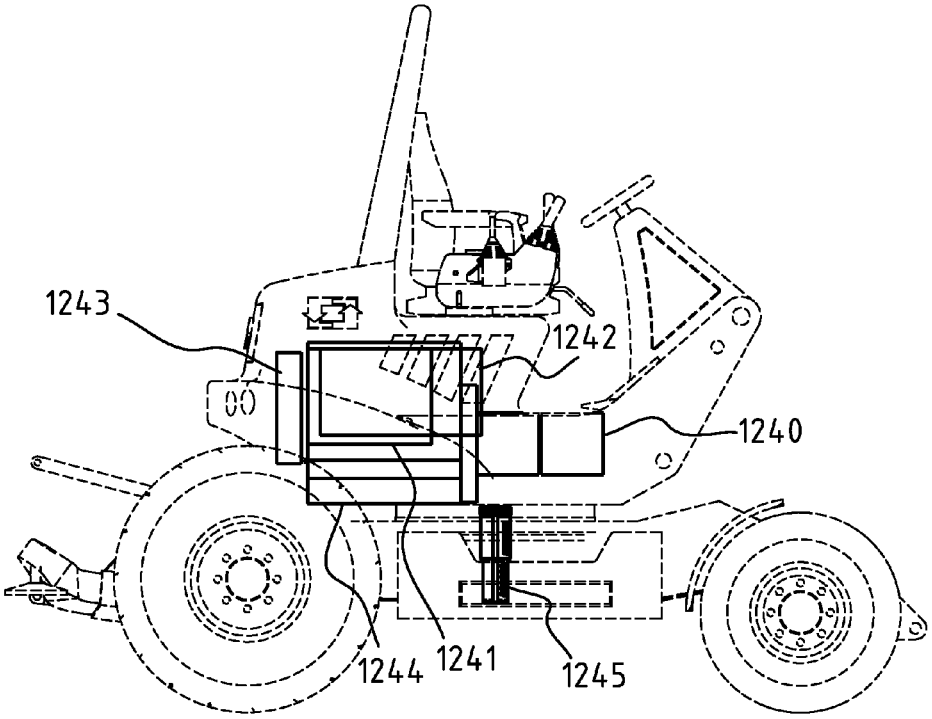
Figure 11C:
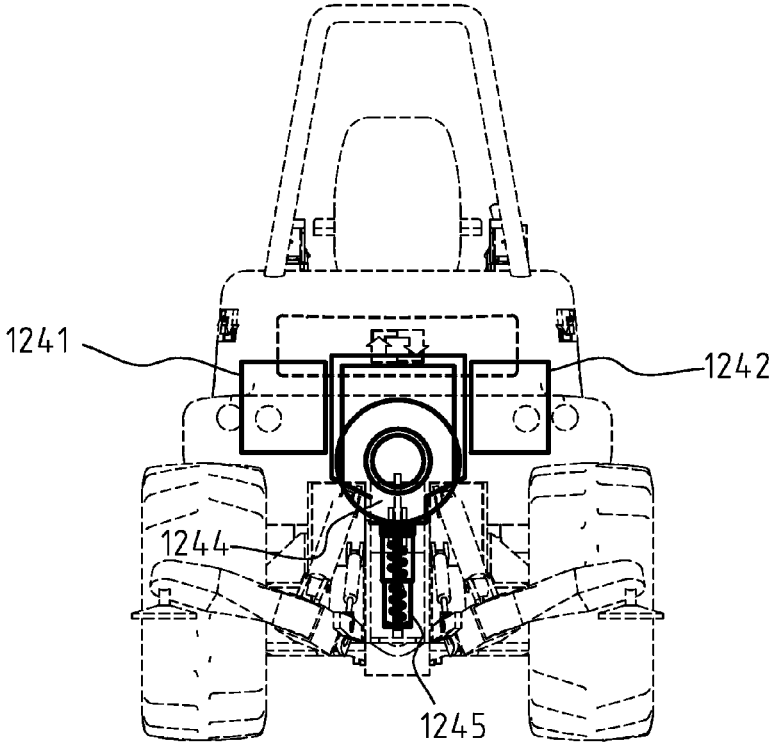
Figure 12:
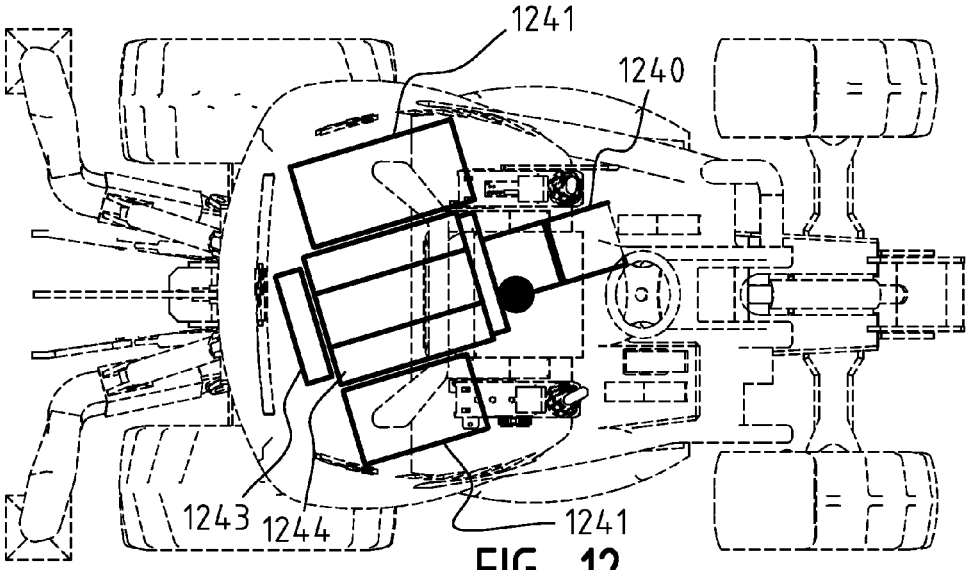
Figure 13A:
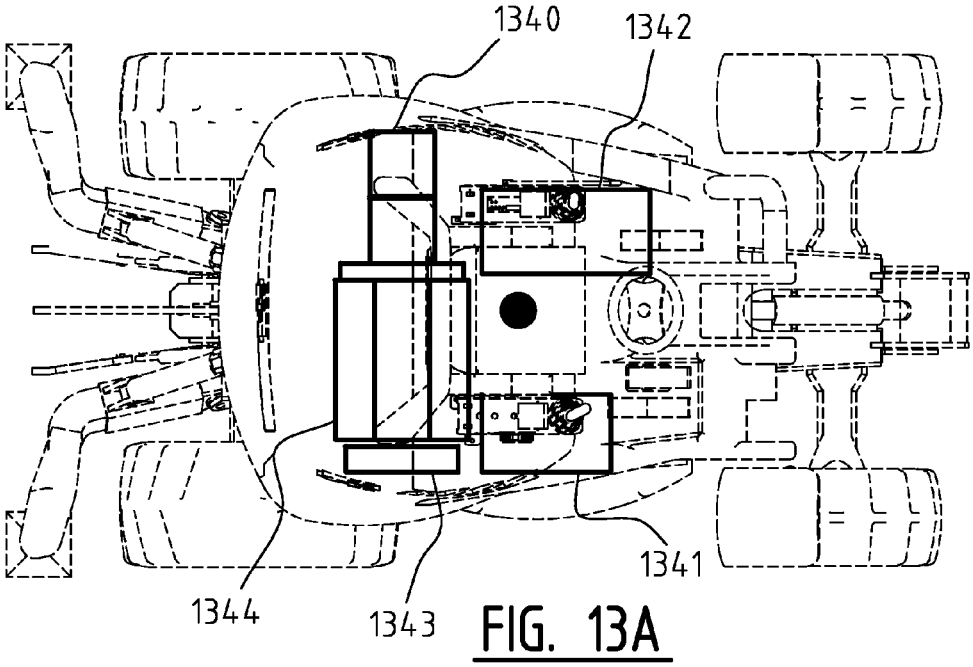
Figure 13B:
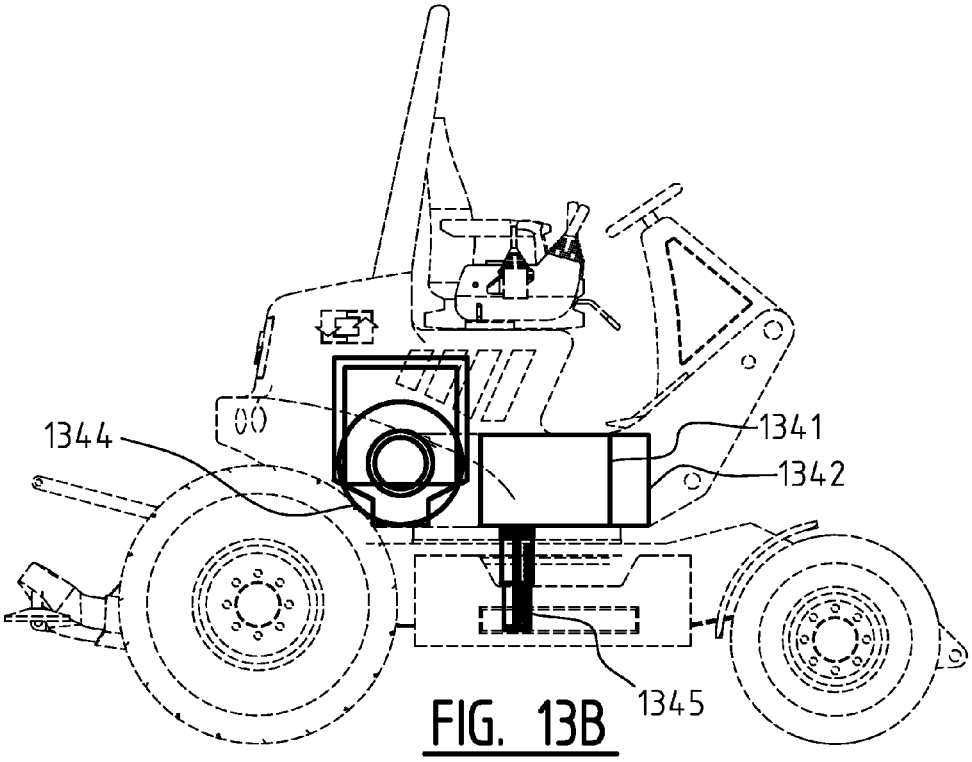
Figure 13C:
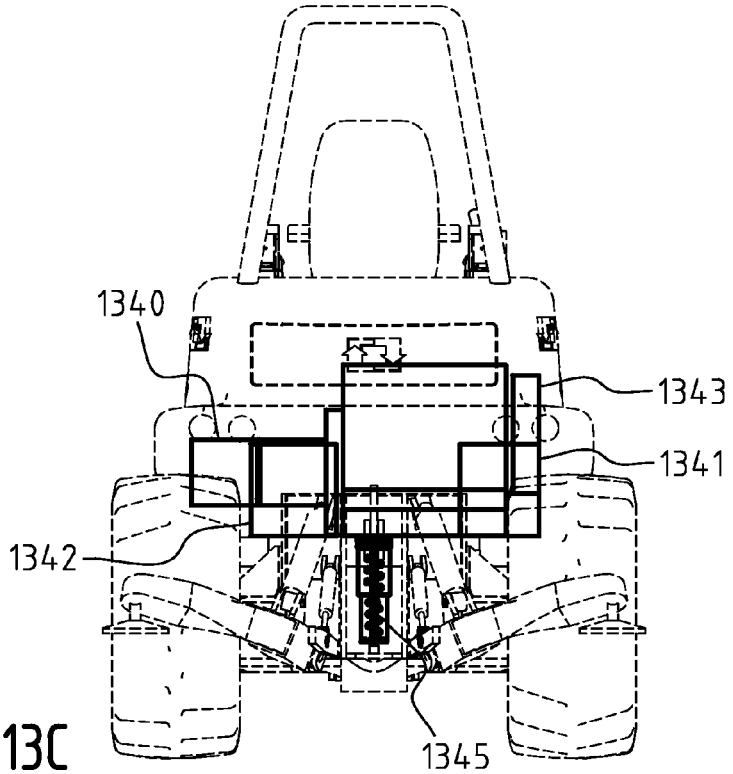
Figure 14A:
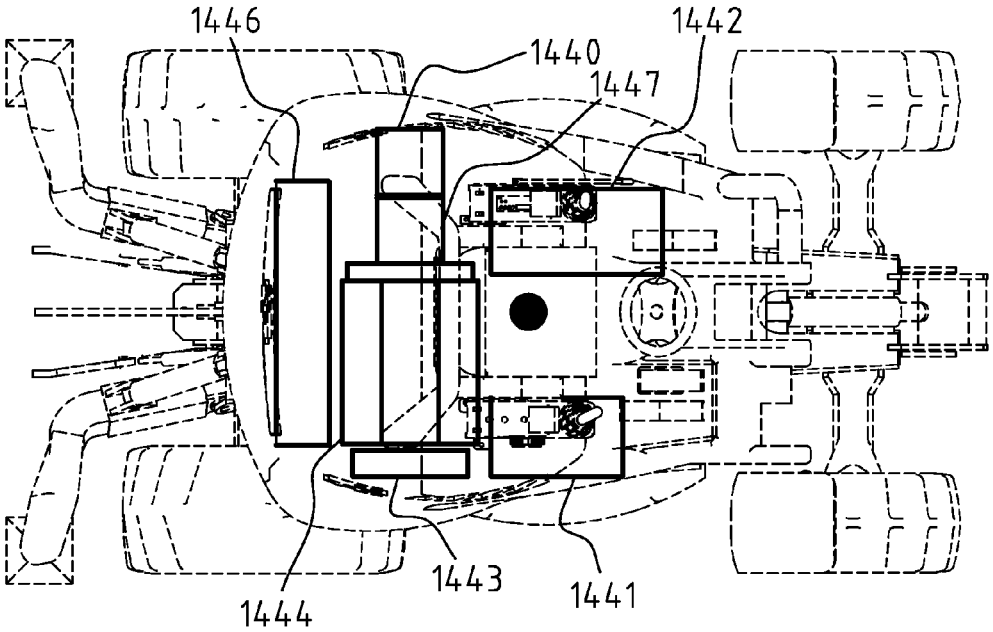
Figure 14B:
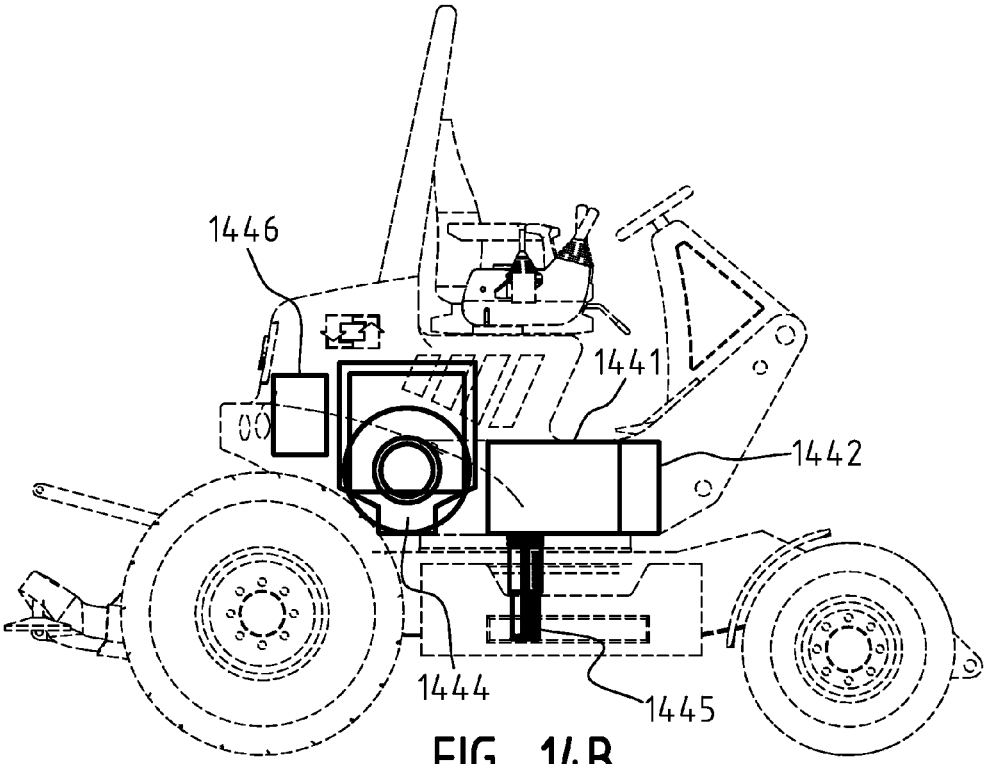
Figure 15A:
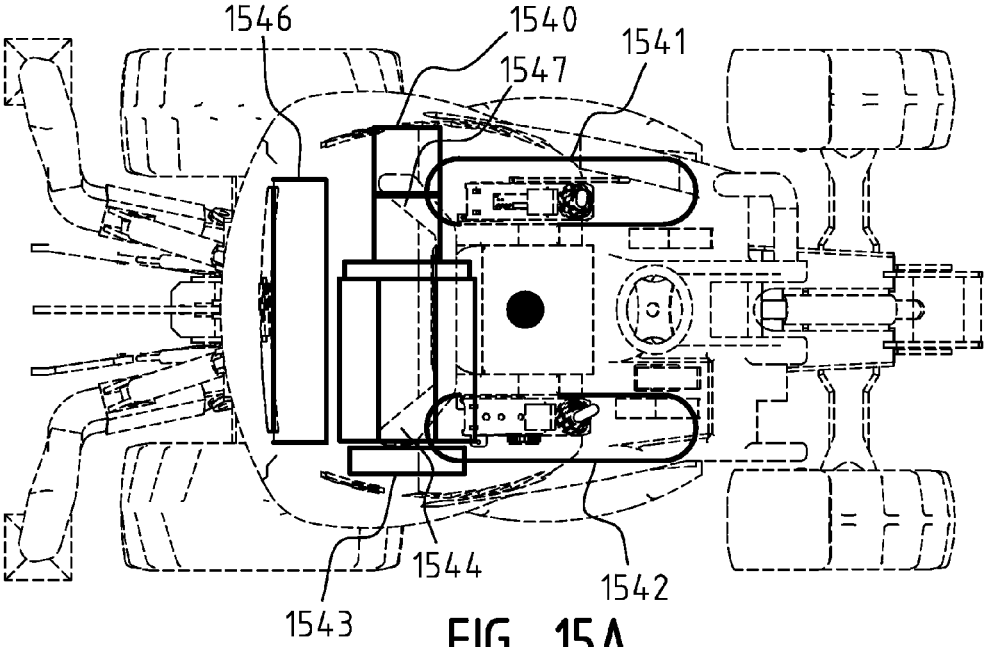
Figure 16A:
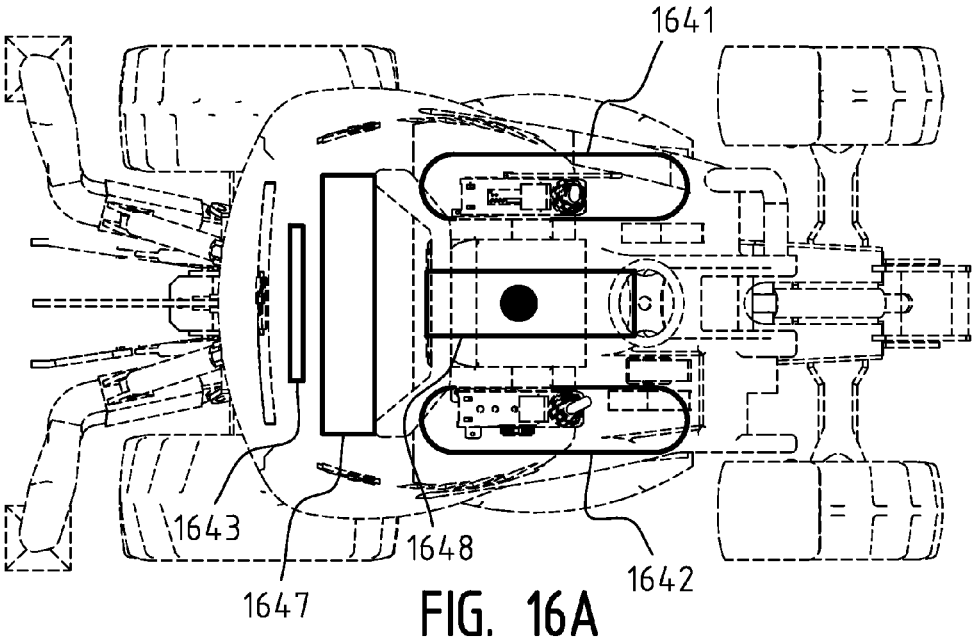
Figure 16B:
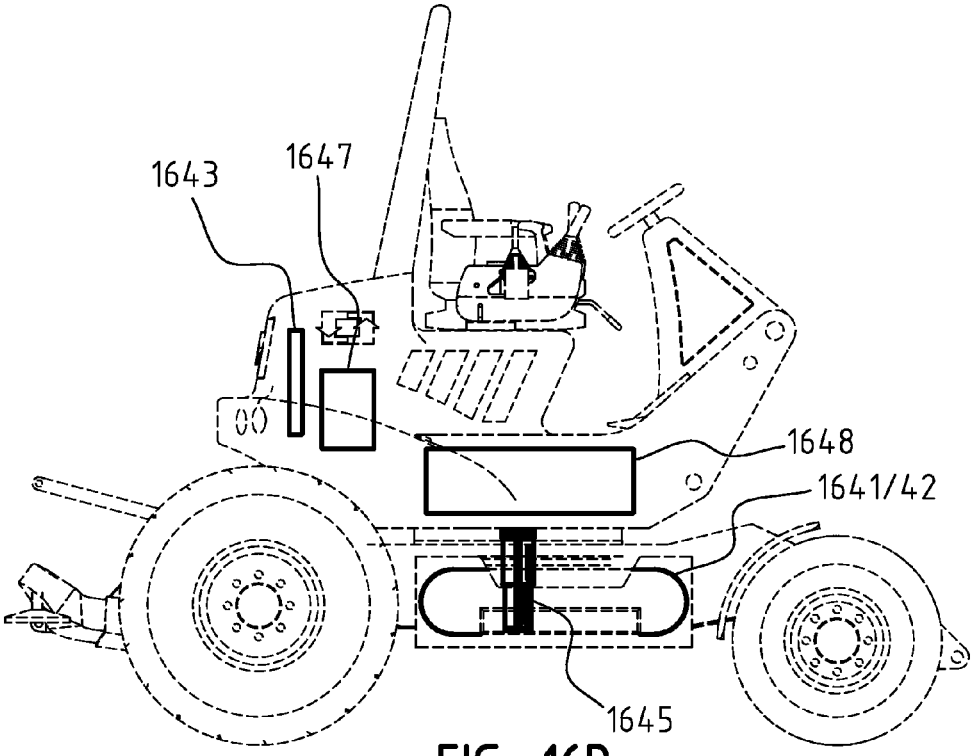
Figure 17A:
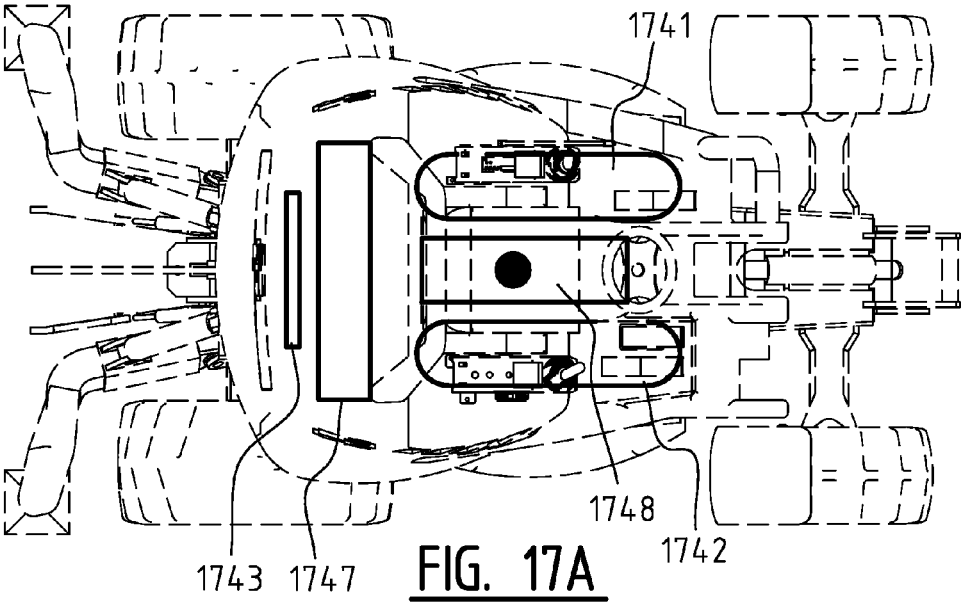
Figure 17B:
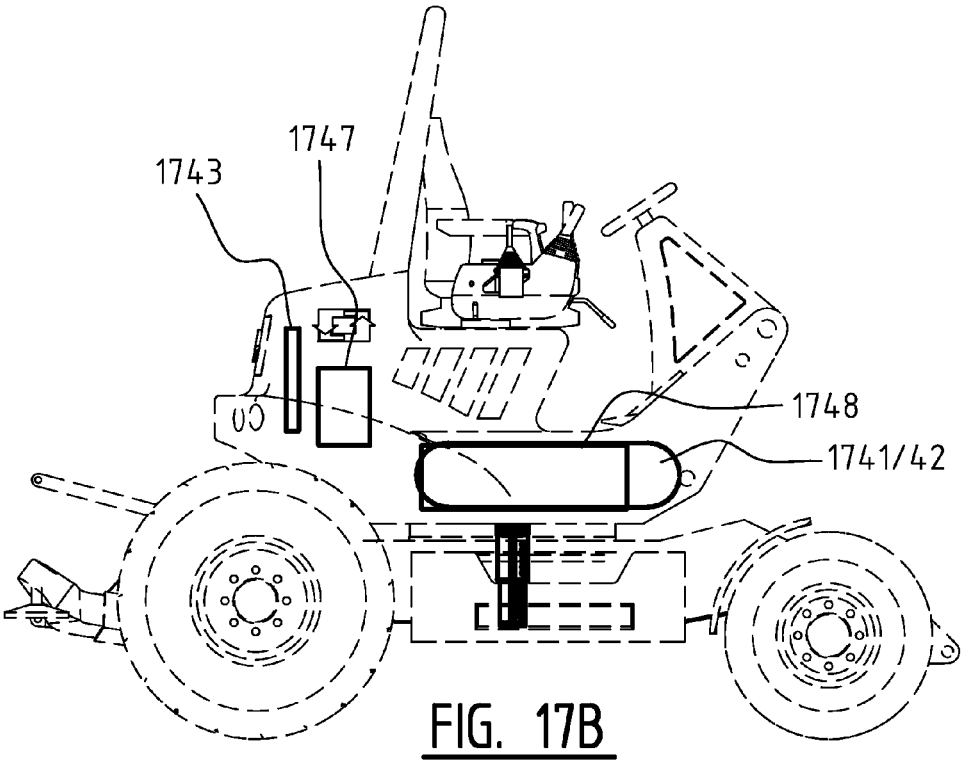
Figure 17C:
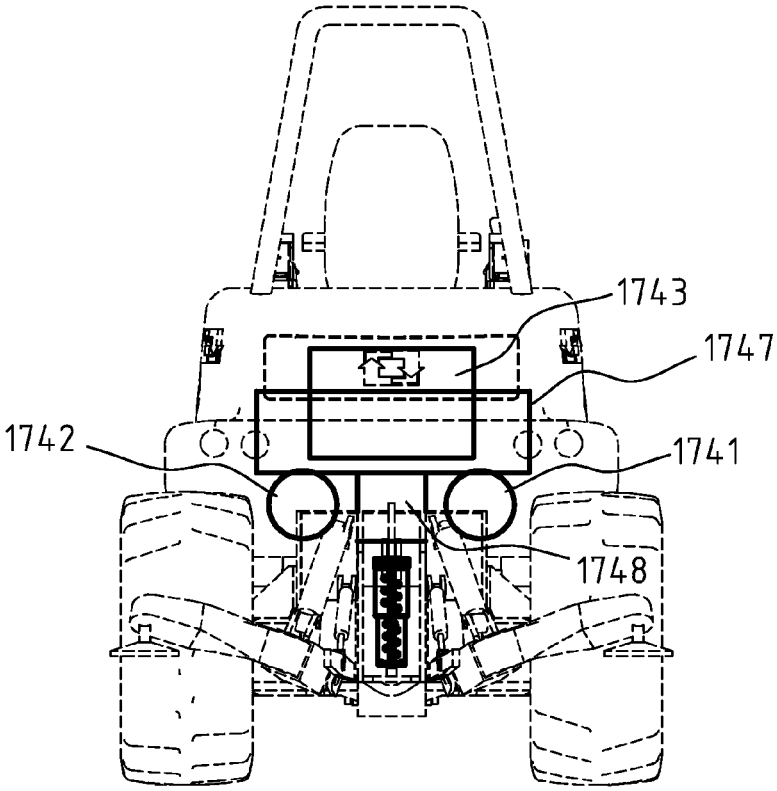
Figure 18A:
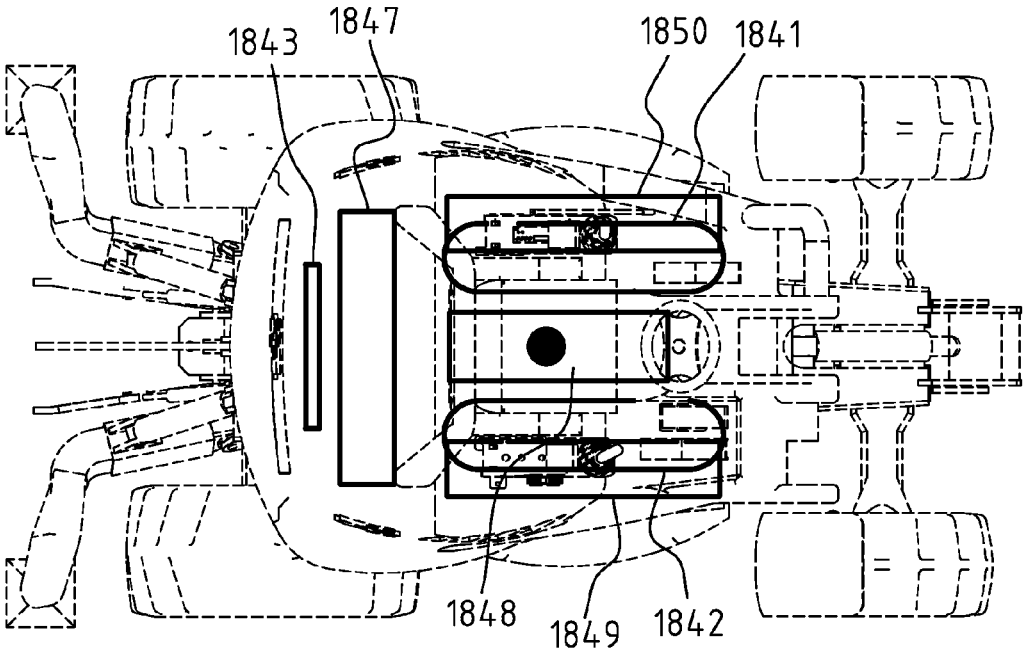
Figure 18B:
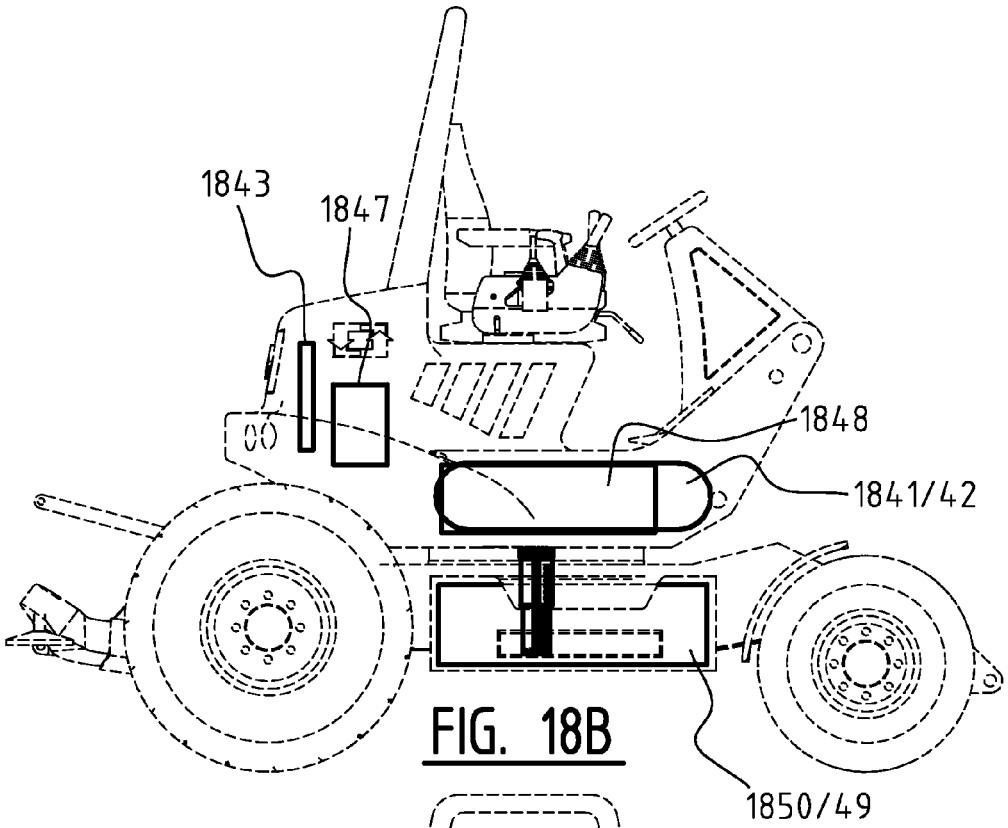
Figure 18C:
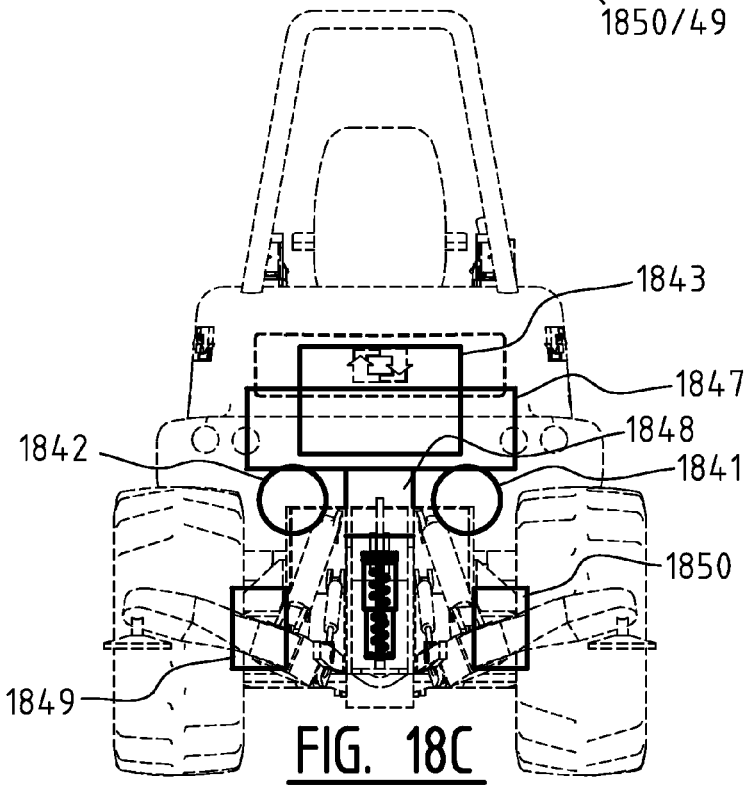
Figure 19A:
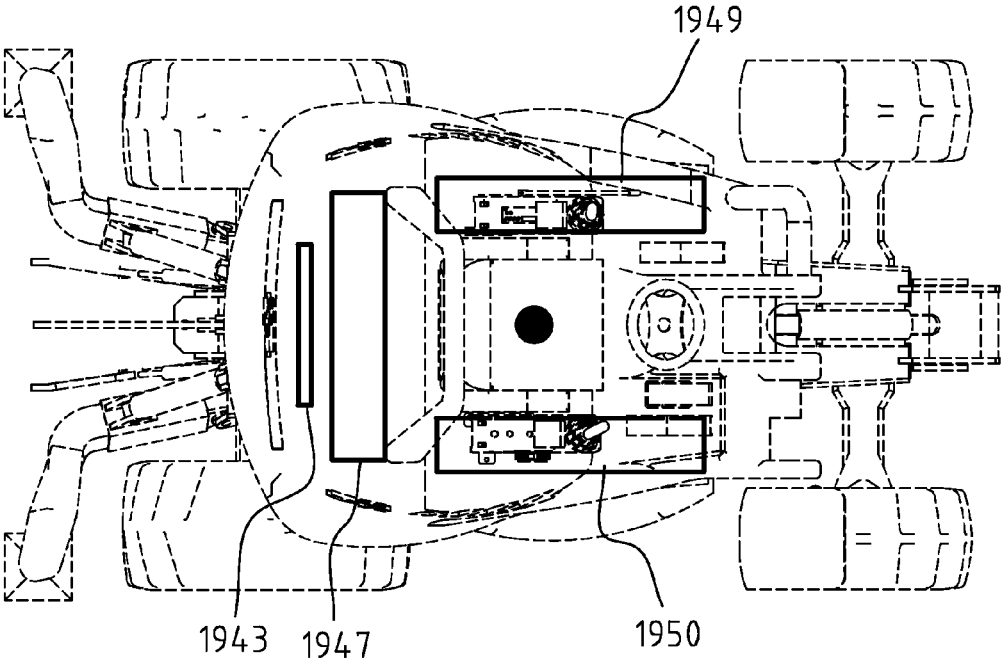
Figure 19B:
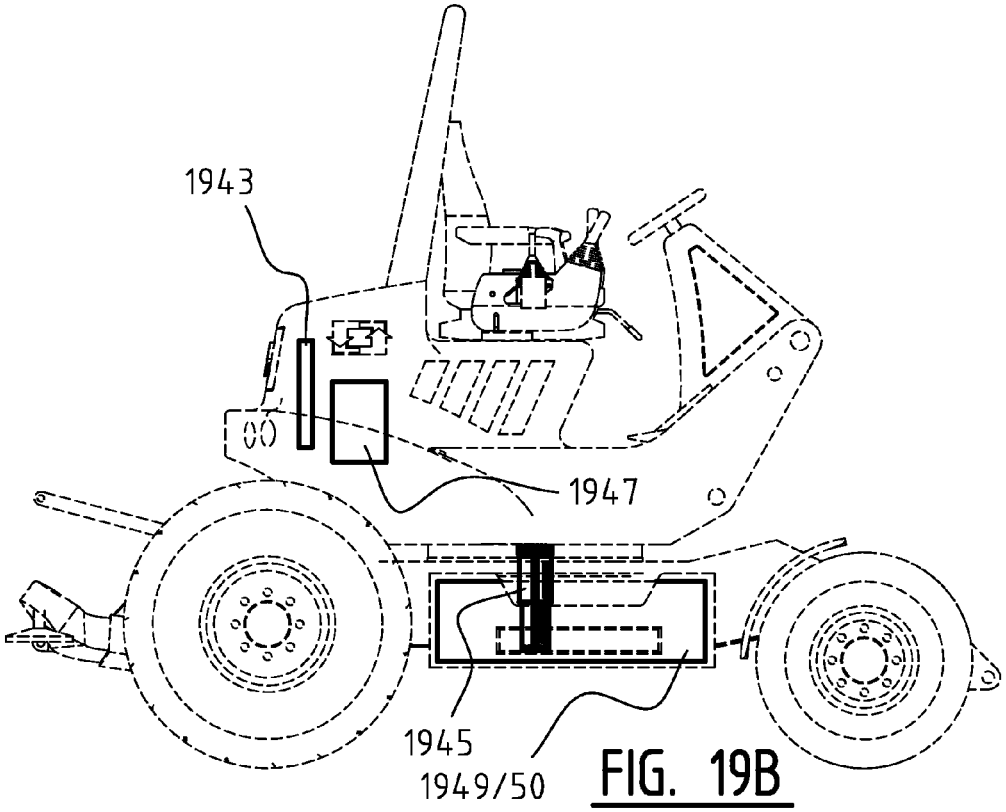
Figure 19C:
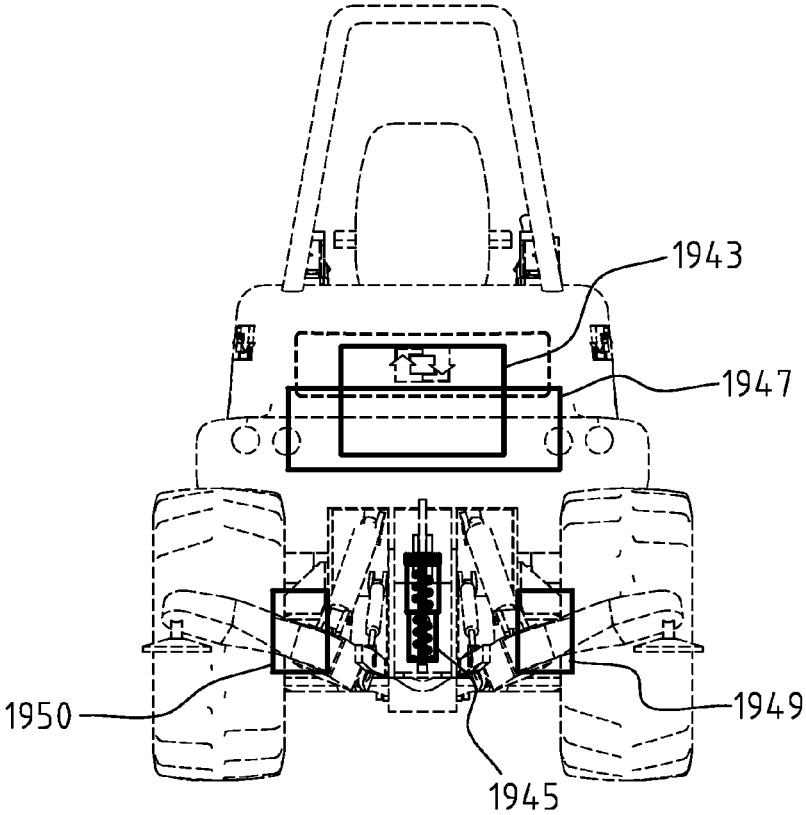
Figure 20A:
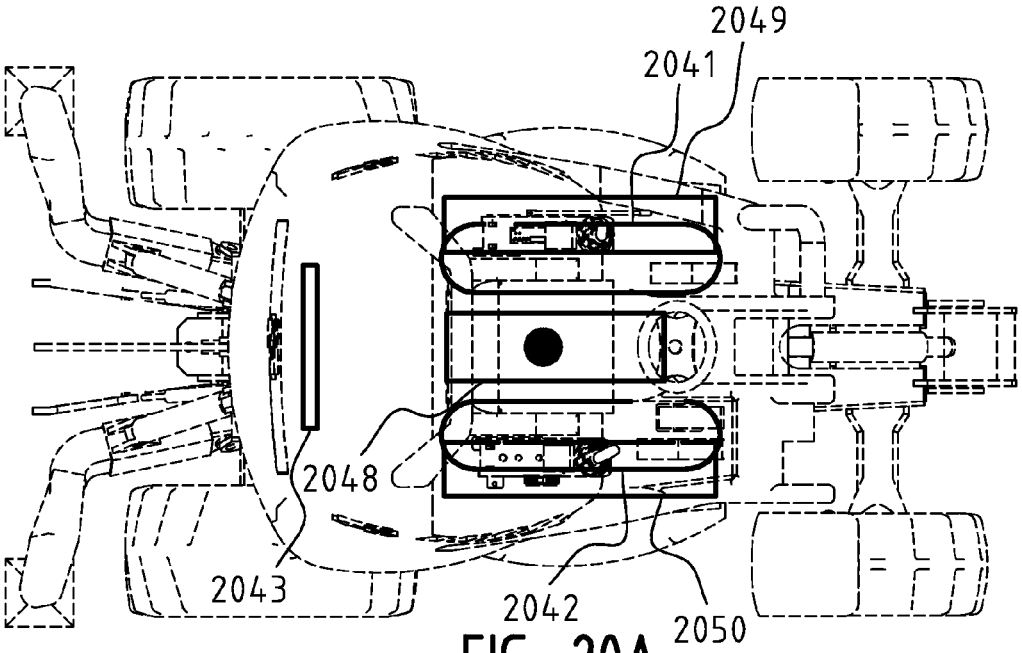
Figure 21A:
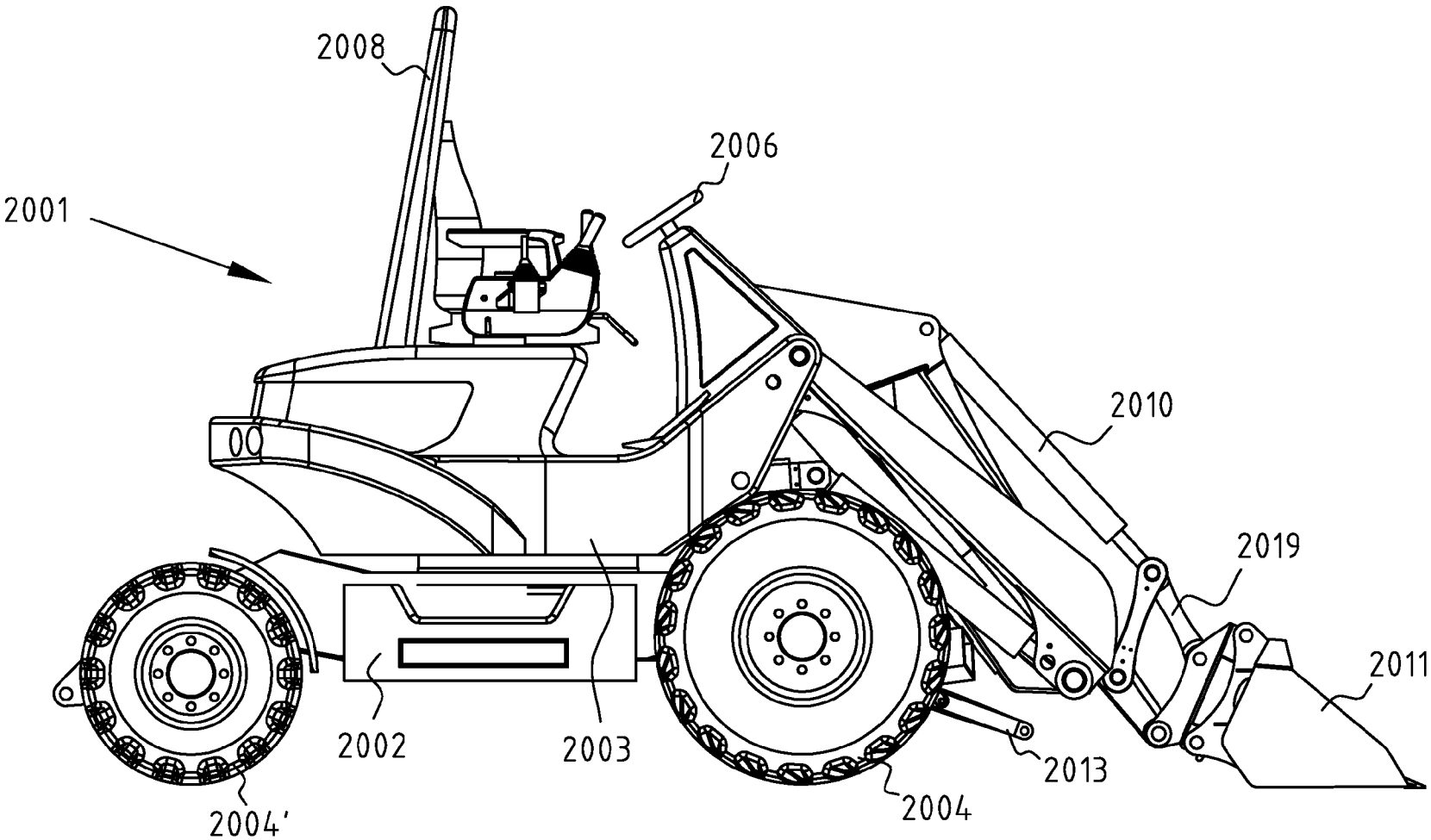
Figure 22:
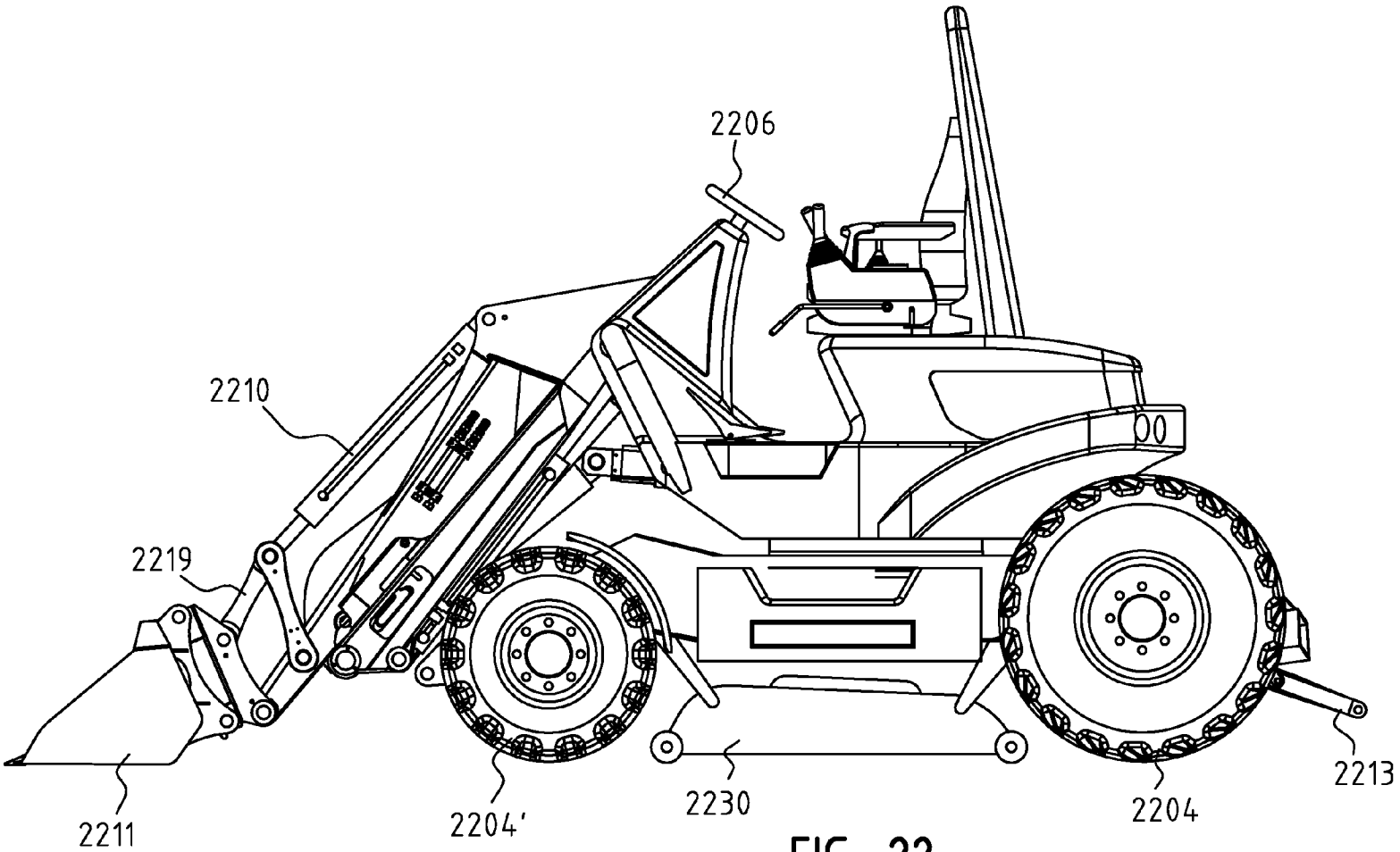
Figure 23:
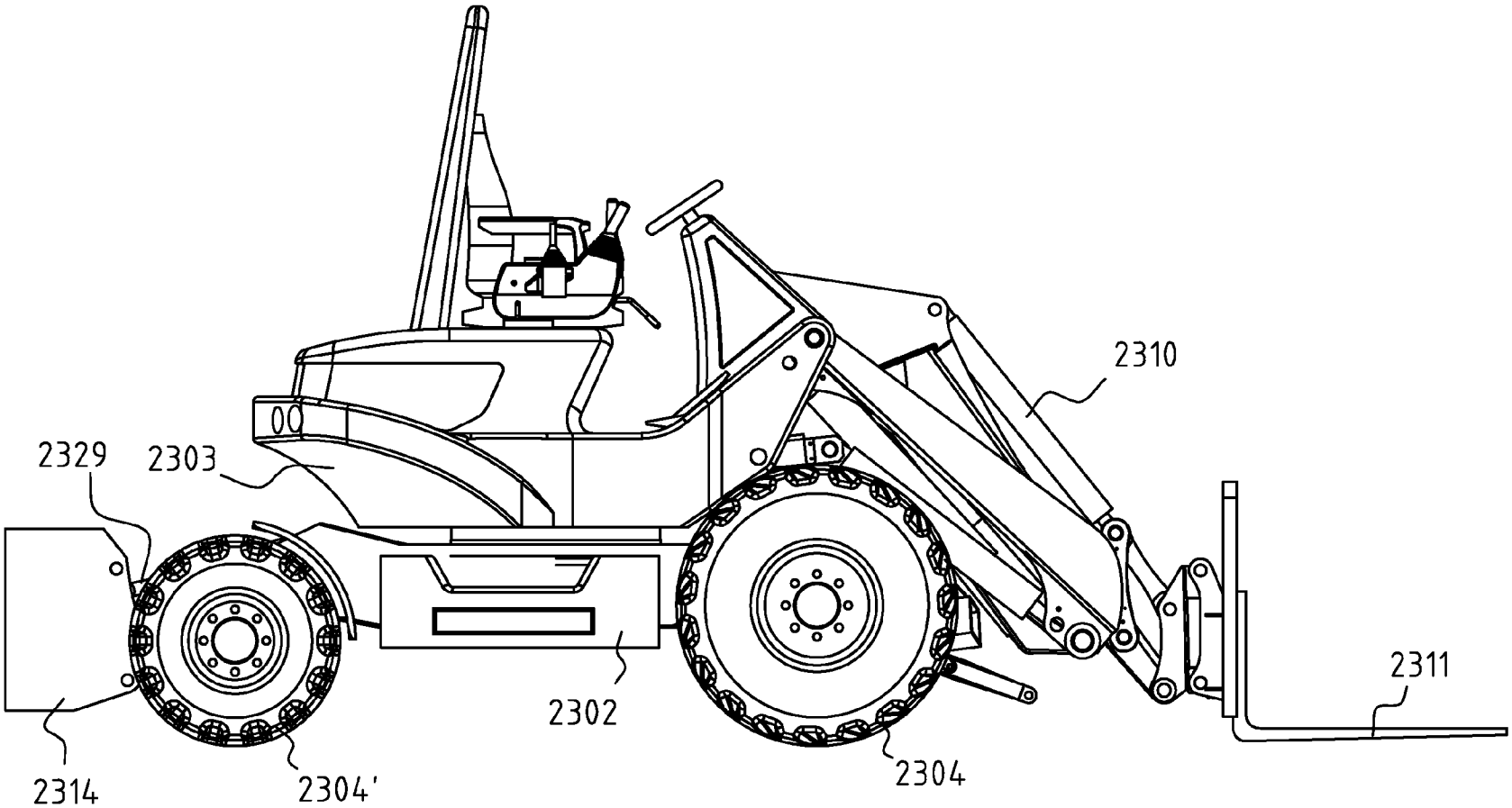
Figure 24:
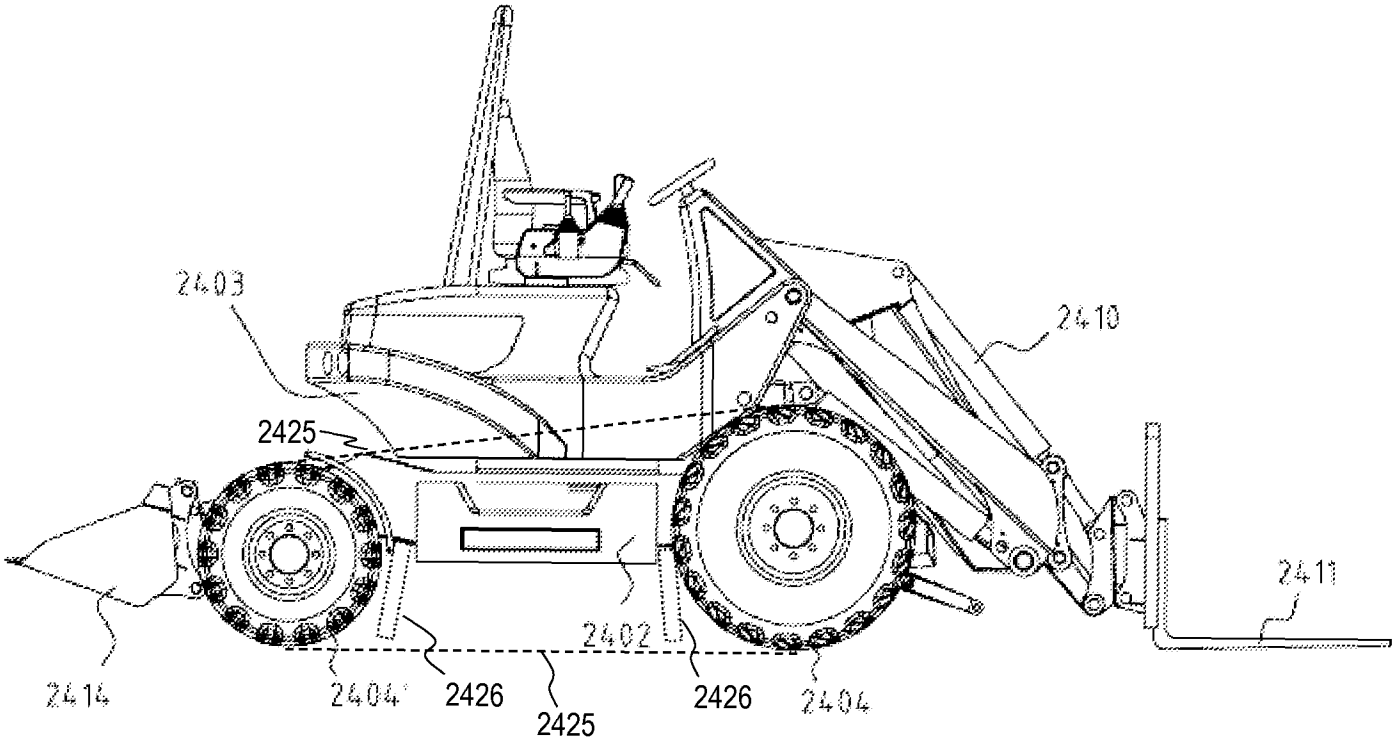
Figure 25A:
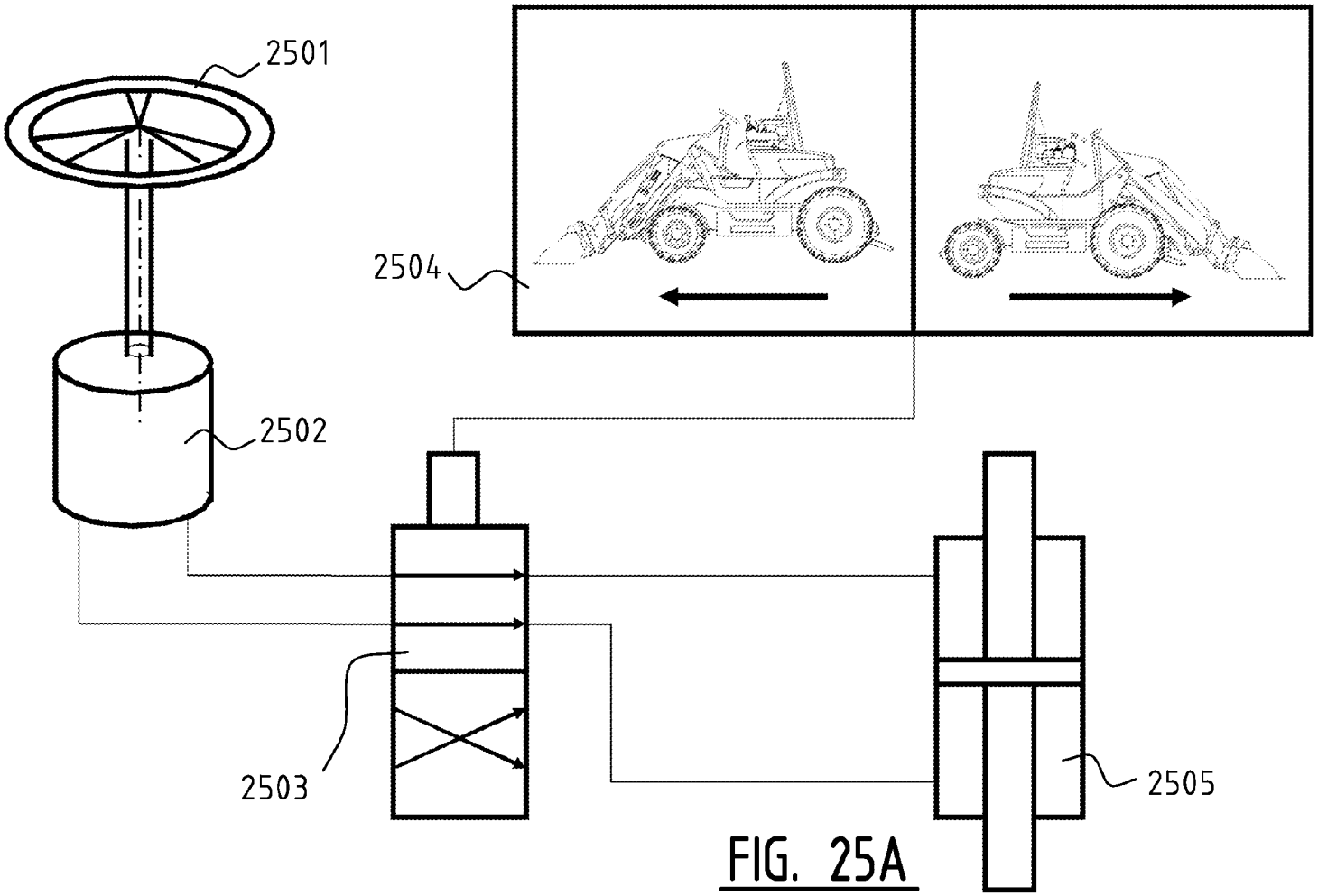
Figure 25B:
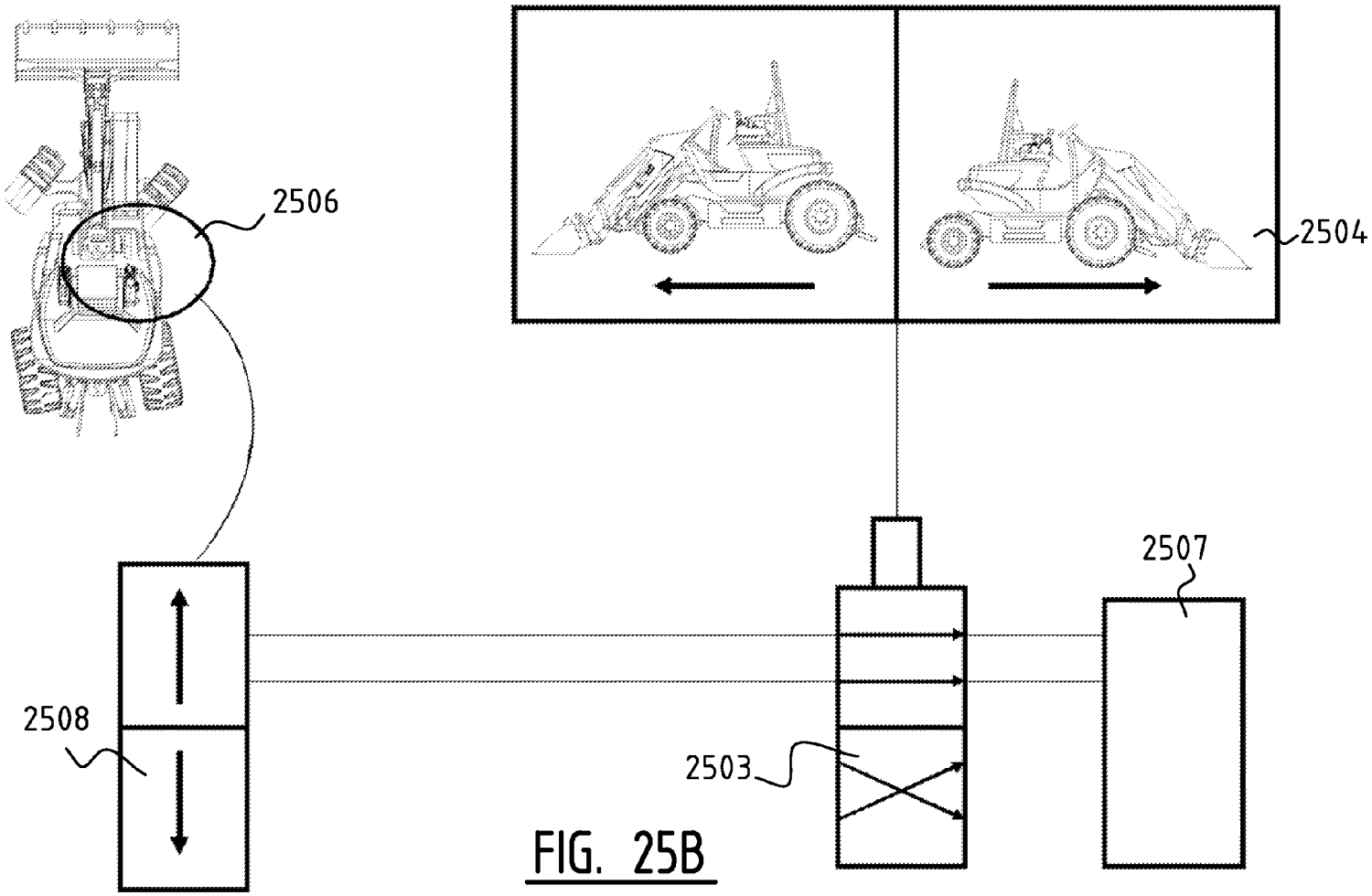

FIGS. 6A to C show a sixth embodiment in which quick change systems are provided at the outer end of the operating arm and on the front side of the main frame;

FIG. 7 shows a seventh embodiment with an operating arm with loading bucket;

FIG. 8 illustrates a top view of an eighth embodiment with four-wheel steering;

FIGS. 9A and 9B illustrate a ninth embodiment with an adapter;

FIG. 10 shows a side view of a tenth embodiment;

FIGS. 11A to 11C show respectively a schematic top view, side view and rear view of an eleventh embodiment according to the present invention, in which the location of the drive means is illustrated;

FIG. 12 shows a top view of a twelfth embodiment;

FIGS. 13A to 13C show respectively a schematic top view, side view and rear view of a thirteenth embodiment according to the present invention;

FIGS. 14A and B show respectively a top view and a side view of a fourteenth embodiment in which a hybrid drive is used;

FIGS. 15A, B and C show respectively a top view, side view and rear view of a fifteenth embodiment according to the present invention;

FIGS. 16A and 16B show respectively a top view and side view of a sixteenth embodiment;

FIGS. 17A to 17C show respectively a top view, a side view and a rear view of a seventeenth embodiment in which a fuel cell is used;

FIGS. 18A to 18C show respectively a top view, side view and rear view of an eighteenth embodiment;

FIGS. 19A to C show respectively a top view, side view and rear view of a nineteenth embodiment;

FIGS. 20A and B show respectively a top view and rear view of a twentieth embodiment;

FIGS. 21(A), (B), (C), (D), (E) show respectively a side view, a top view, a top view of a variant, a perspective view as seen from the front and a perspective view as seen from the rear of a twenty-first embodiment;

FIG. 22 shows a side view of a twenty-second embodiment;

FIG. 23 shows a side view of a twenty-third embodiment;

FIG. 24 shows a side view of the twenty-fourth embodiment;

FIG. 25(A) illustrates schematically the switching of the travel direction; and FIG. 25(B) illustrates schematically the switching of the travel direction and from forward to reverse.

FIGS. 1A to 1E show a first embodiment of a mobile apparatus according to the invention in the form of a tractor. Mobile apparatus 1 comprises a main frame 2 displaceable on wheels 4 and a sub-frame 3 mounted thereon for rotation round a vertical axis. Sub-frame 3 is provided with a driver's seat 5 and a number of steering elements, including joysticks 7, a steering wheel 6 and pedals 15. Main frame 2 is preferably situated as low as possible and in the shown embodiment lies substantially lower than the top side of front and rear wheels 4. Sub-frame 3 has a bottom side which lies lower than the top side of rear wheels 4 and is designed such that the sub-frame extends above rear wheels 4, wherein a recess 16 is provided in the bottom side such that the sub-frame can rotate freely without making contact with wheels 4.

Figure 1A:
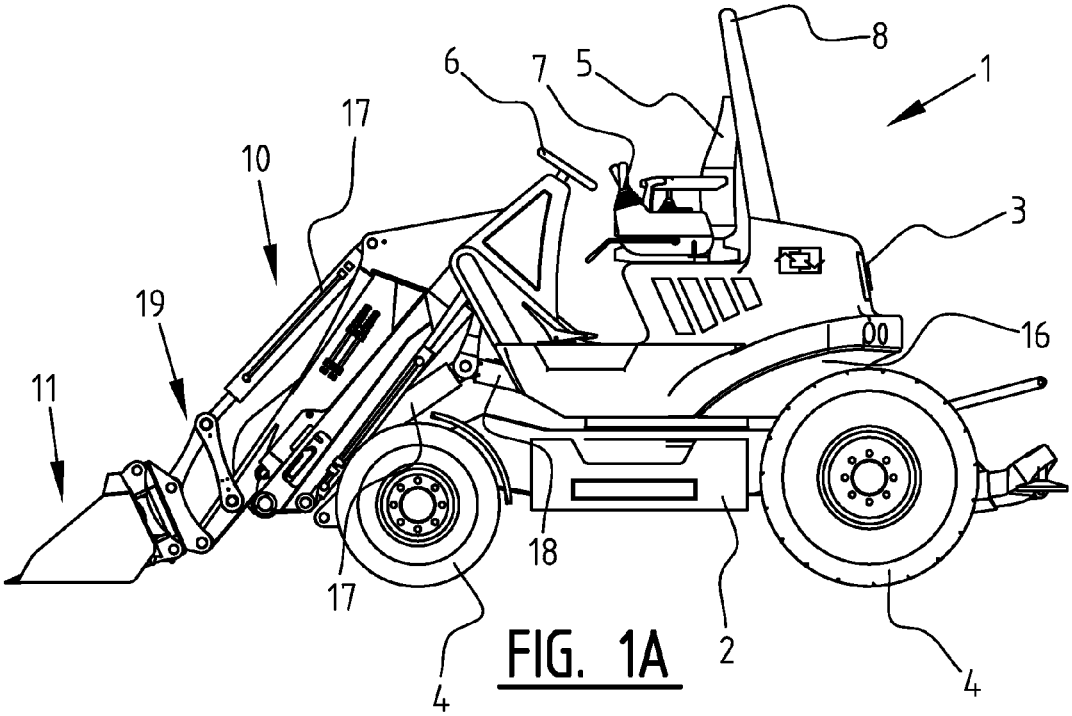
FIGS. 1A to 1E show respectively a left side view, a rear view, a front view, a right side view and a top view of a first embodiment of a mobile apparatus according to the invention.
Figure 1B:
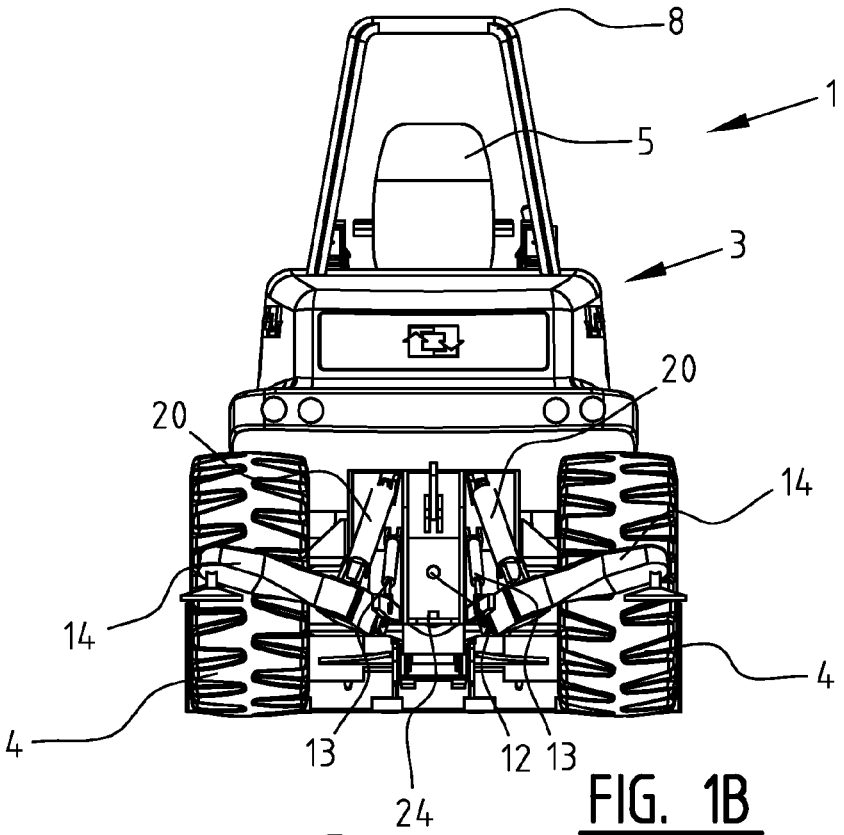
Figure 1C:
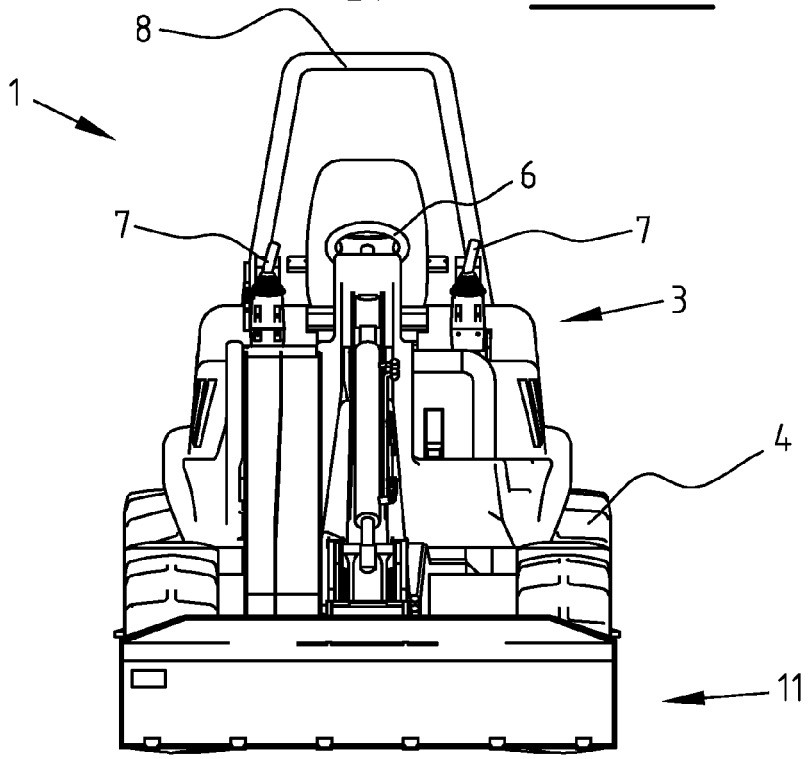
Figure 1D:
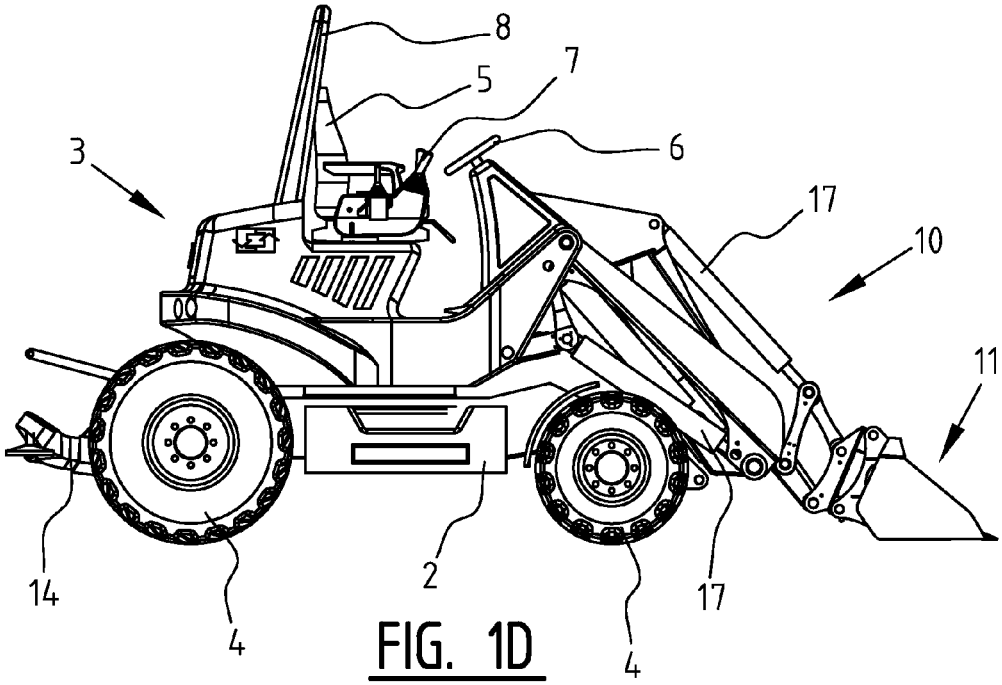
Figure 1E:
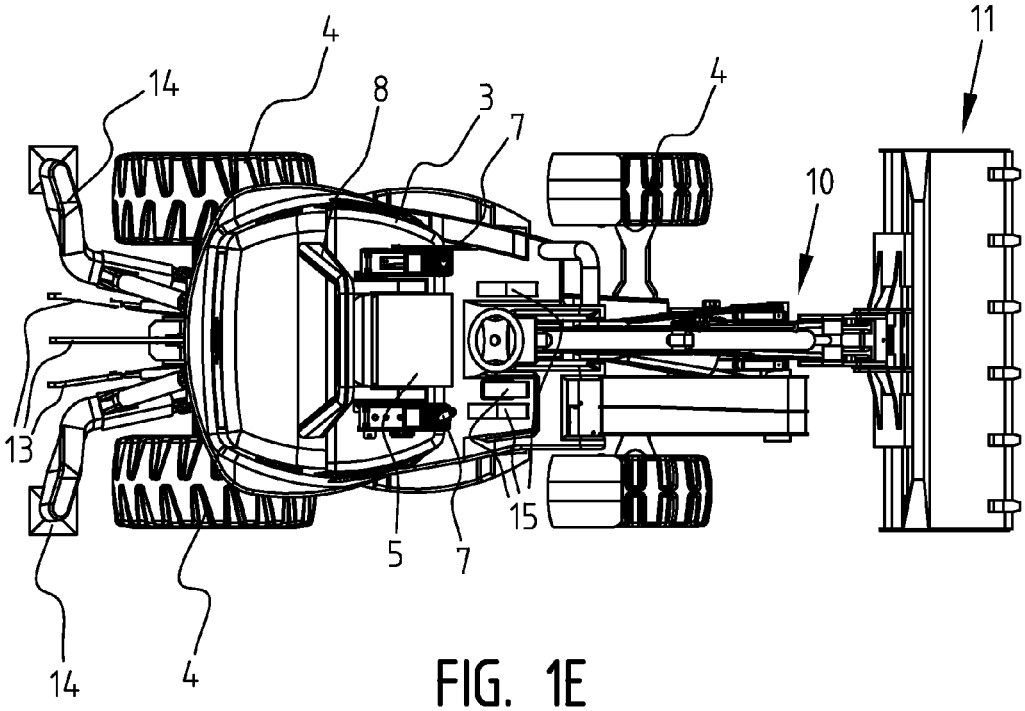

As shown best in FIG. 1B and FIG. 1E, main frame 2 is provided on the rear side with a three-point lifting device. Such a lifting device is standard in agriculture and generally known to the skilled person, so detailed description thereof is not necessary. Further provided on the rear side of main frame 2 is a power takeoff shaft 12 (see FIG. 1B). In this way attachments coupled to the power takeoff can also be driven by the motor of the mobile apparatus. Such a power takeoff is generally known and will not be discussed in detail here. Note that such a power takeoff can also be provided on the front side of the mobile apparatus. A tow-hook 24 is further provided on the rear side of main frame 2.

An operating arm 10 with an attachment 11 is further mounted on sub-frame 3. In the shown embodiment operating arm 10 consists of an articulated arm on which a loading bucket 11 is mounted. The articulations of operating arm 10 are moved using a number of cylinders 17. The lower cylinder 17 is connected to the sub-frame by means of adjusting device 18. Attachment 11 is connected via a parallelogram hinge 19 to last cylinder 17. In this way the position of the attachment can be adjusted relative to the last articulation. Adjusting device 18 is used to optimize the geometry of actuating member 17 (or the actuating members in a multiple variant) relative to the articulation. In the loading bucket position (lowest position) the articulation can descend further downward due to the adjusting device and in the digging position (uppermost position) the articulation can be moved higher. The angle which the actuating member makes with the arm is then also better in the two different positions and thereby produces more force.

As shown best in FIGS. 1B and 1E, the main frame is provided at the rear with two stabilizers 14 in the form of jacks. These stabilizers are preferably partially removable. In the shown embodiment the part of the jack located on the outside is slidable into a part of the jack lying closer to main frame 2, whereby the jack can be made shorter so as to leave space for agricultural attachments when they are coupled to three-point lifting device 13 or to power takeoff 12. Control members 20 are further provided for moving jacks 14.

Figure 2A:
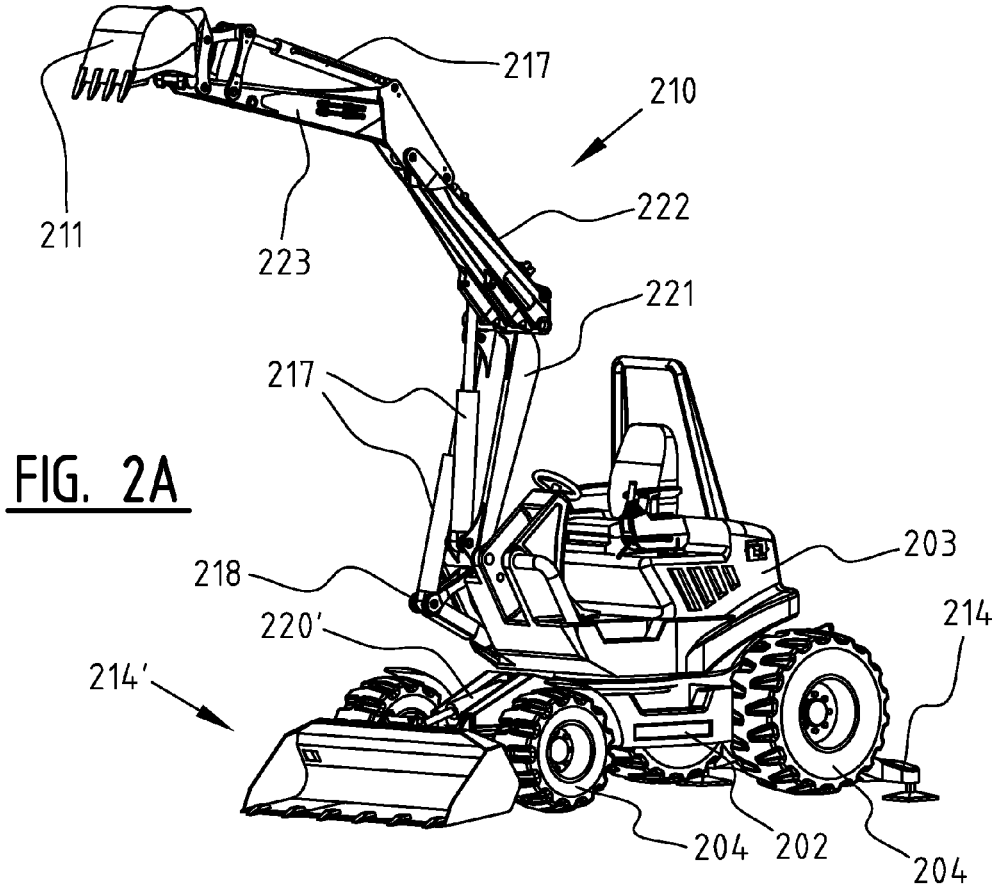
FIGS. 2A to 2D show different digging positions of an articulated arm of a second embodiment of a mobile apparatus according to the invention.
Figure 2B:
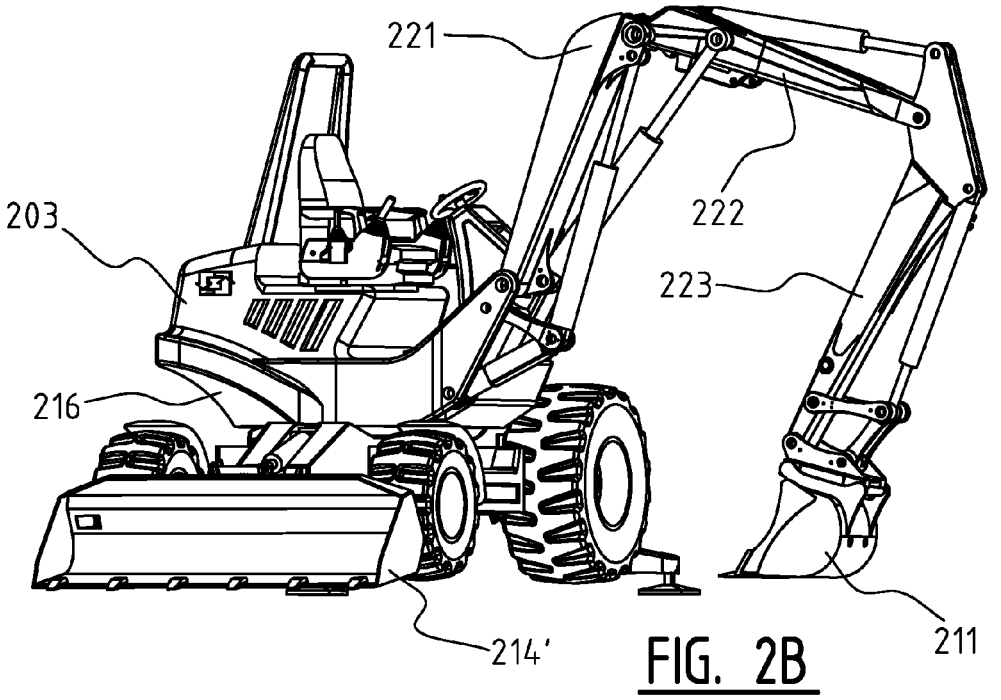

FIGS. 2A to 2D show a second embodiment of a mobile apparatus according to the invention in four different positions. Similar components are designated with the same reference numeral, wherein 200 is added. Operating arm 210 has three articulations: 221, 222, 223 which are movable relative to each other using cylinders 217. Lower cylinder 217 is connected to sub-frame 203 using an adjusting device 218. In FIG. 2A the adjusting device is placed in the highest position. Provided at the rear of main frame 202 are stabilizers 214 embodied as described with reference to FIGS. 1A to 1E. At the front of main frame 202 an additional stabilizer 214' is provided in the form of a loading bucket connected to a control member 220'. The loading bucket is in this way given a useful function when it is not in use. FIG. 2B shows a position in which sub-frame 203 is rotated through about 90° such that operating arm 210 is situated at the side of the mobile apparatus. The arm is situated here in a digging position. FIG. 2B further shows clearly that sub-frame 203 is provided with a recess 216 which allows free rotation of the sub-frame while the bottom side of the sub-frame lies considerably lower than the top side of the rear wheels of the mobile apparatus. The geometry of adjusting device 218 is further typically adapted to the geometry of the sub-frame such that they do not make contact with each other during rotation.

Figure 2C:
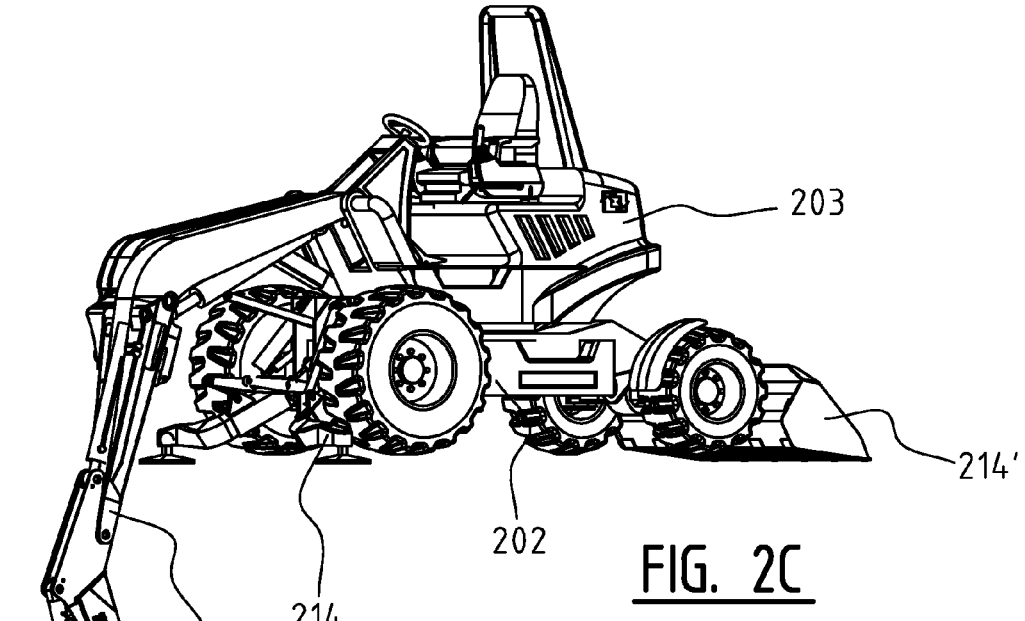
Figure 2D:
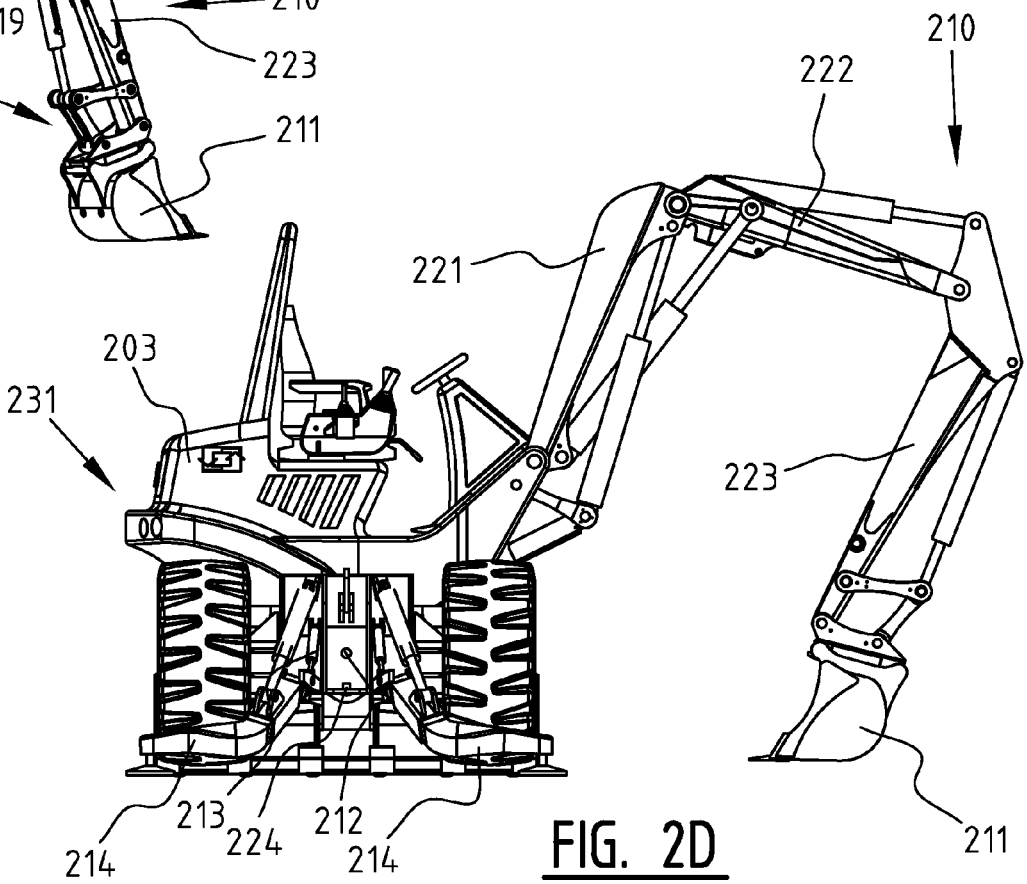

As best shown in FIG. 2D, sub-frame 203 is preferably dimensioned such that the counterweight in the form of a wing on the rear side of the sub-frame (see no. 213) extends substantially no further than jacks 214. In this way the mobile apparatus remains completely stable during digging.

FIG. 2C further shows the position in which sub-frame 203 is rotated through 180° such that the digging arm is situated on the rear side of the mobile apparatus. In this way the second embodiment according to the invention can be used as a backhoe loader. Finally, FIG. 2D shows sub-frame 203 rotated through substantially 90° to the other side compared to FIG. 2B.

Figure 3A:
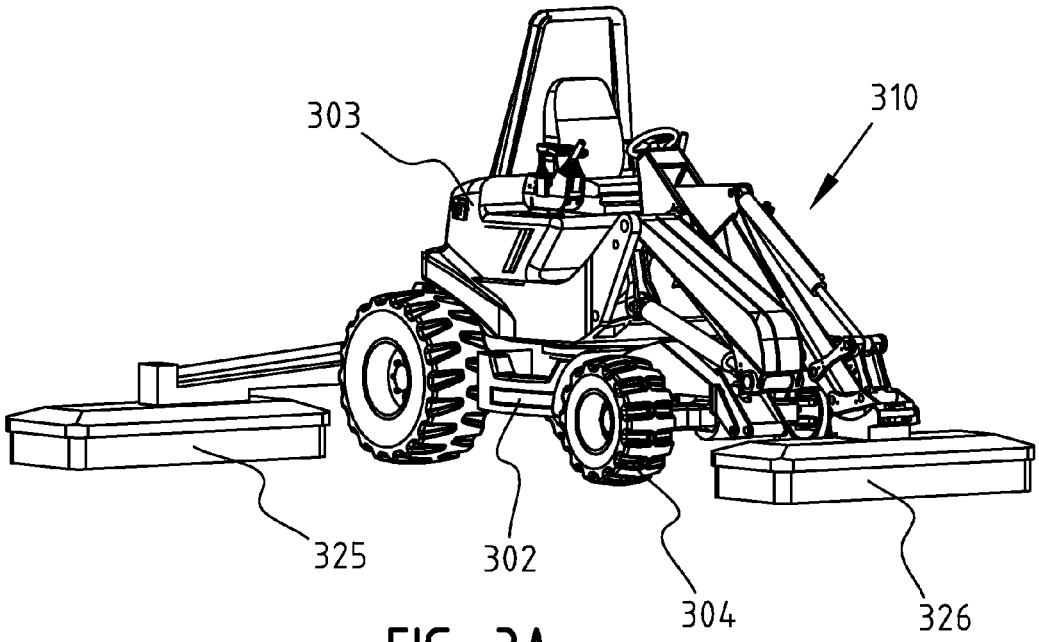
FIGS. 3A and 3B show a third embodiment of a mobile apparatus according to the invention, wherein agricultural attachments are coupled at the front and rear.
Figure 3B:
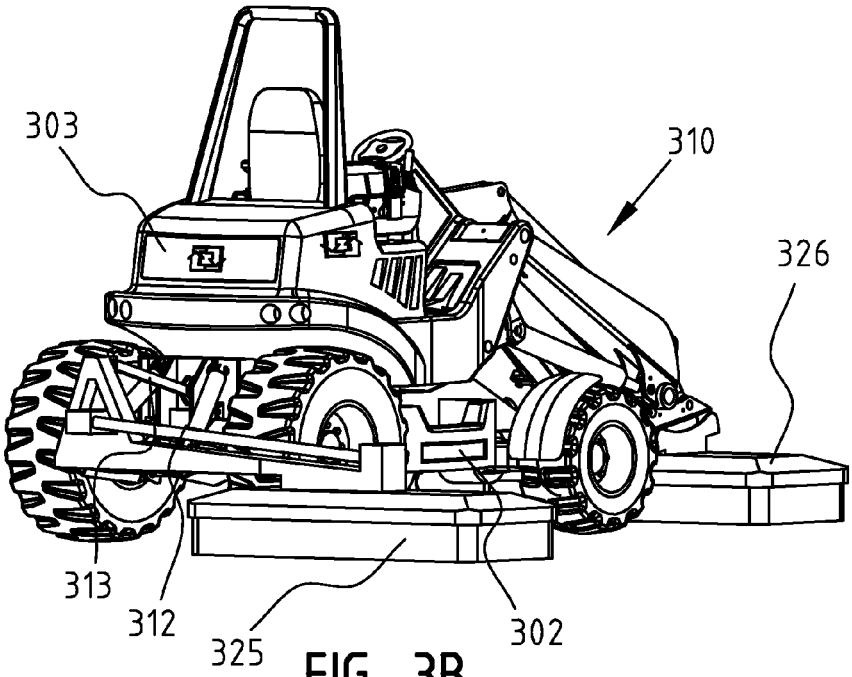

FIGS. 3A and 3B show a third embodiment of a mobile apparatus according to the invention in which agricultural attachments are coupled on the front and rear side. The same reference numerals as in FIGS. 1A to 1E are once again used, wherein 300 is added. On the front side an agricultural attachment 326 is coupled to the outer end of operating arm 310. Operating arm 310 is connected to sub-frame 303 which is rotatably mounted on main frame 302. At the rear of the mobile apparatus an agricultural attachment 325 is connected to the three-point lifting device 313. Agricultural attachment 325 is further driven via power takeoff 312.

Figure 4A:
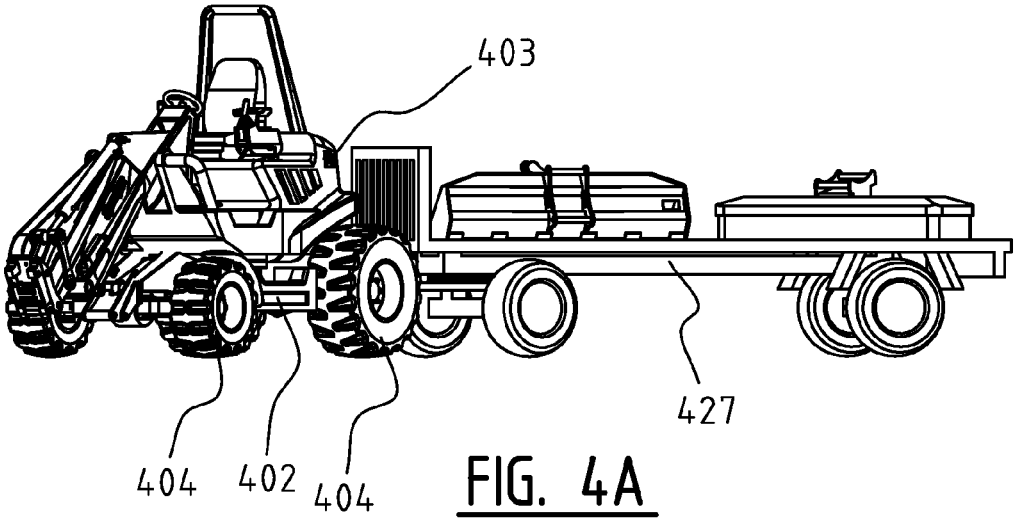
FIG. 4A shows a fourth embodiment, wherein a trailer is coupled at the rear.
Figure 4B:
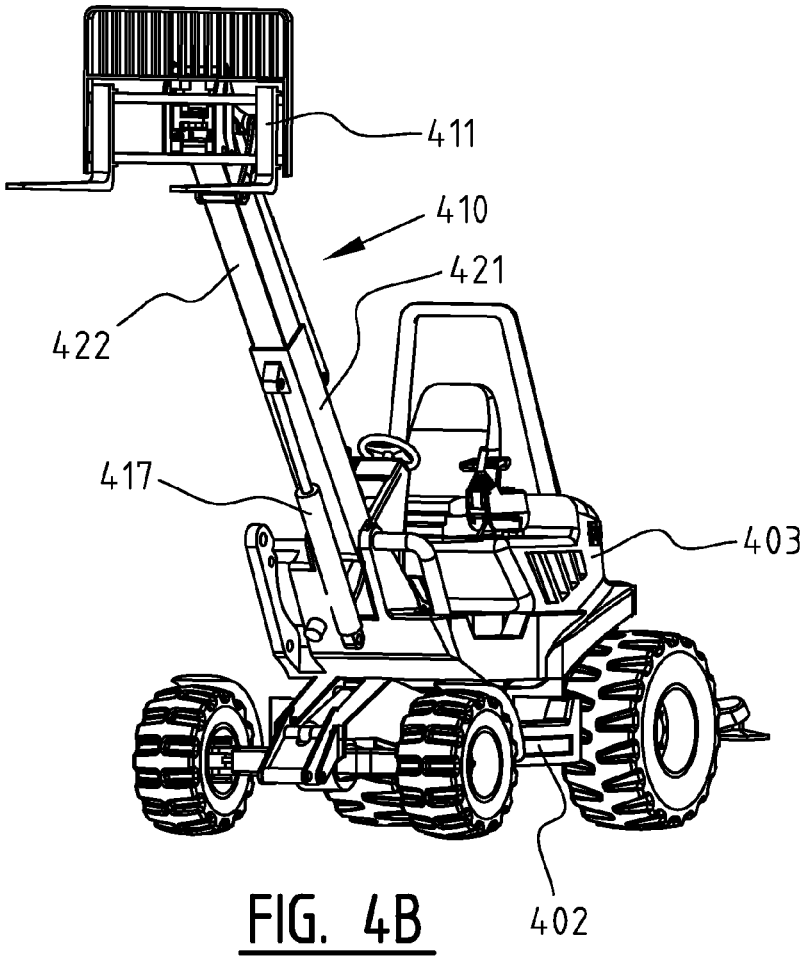
FIG. 4B shows a fourth embodiment with a telescopic loading bucket arm.

FIG. 4A shows a fourth embodiment wherein a trailer 427 is connected to tow-hook. FIG. 4B shows the same embodiment without trailer, with an operating arm 410 in the form of a telescopic arm with two parts 421, 422 which can slide into each other. An attachment 411 is coupled to the outer end of telescopic arm 410.

Figure 5:
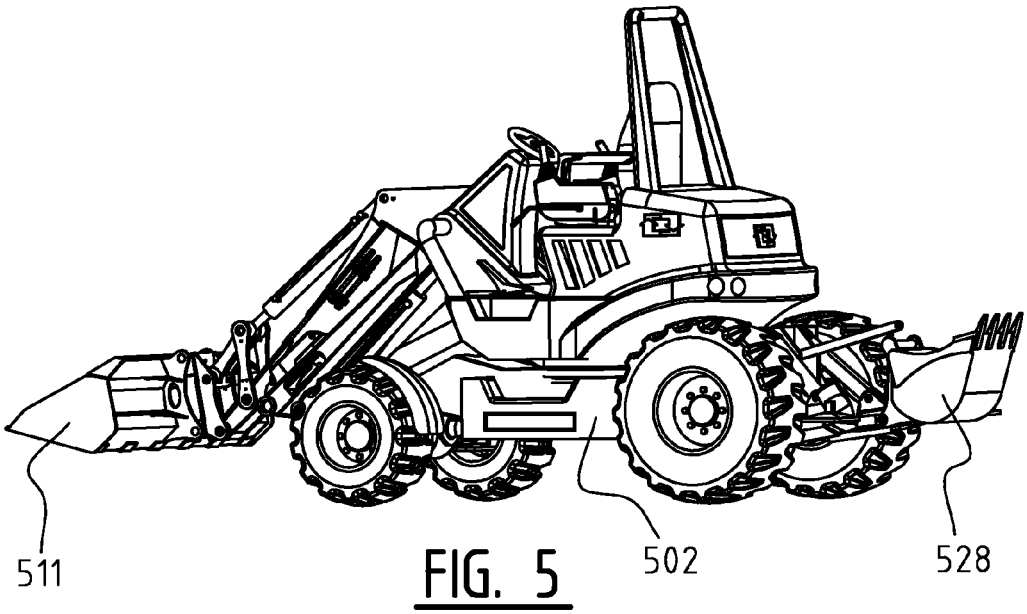
FIG. 5 shows a fifth embodiment with a digger bucket at the rear, this digger bucket being attached to the three-point lifting device.

FIG. 5 shows a fifth embodiment with a digger bucket 528 connected at the rear to main frame 502. When the machine is in the load bucket position (wherein the operating arm functions as a single lifting arm with a loading bucket 511 on its outer end) and is used as loading bucket or so-called tool carrier, it can then be useful to also carry the digger bucket 528 at the same time. It may after all be the case that digging will once again be necessary at another location on the workplace. Digger bucket 528 can then be readily uncoupled and mounted once again on the operating arm. During digging the loading bucket 511 can be used as support point at the front, see FIG. 2A. The lifting device therefore has solely the function as support here, although this is now useful since the lifting device can itself also lift the bucket.

FIGS. 6A to 6C further show an embodiment with yet another variant of a stabilizer on the front side. The front side is provided with a quick change system 629 to which an attachment can be coupled. Quick change system 629 is controlled using a control member 629'. In FIGS. 6B and 6C can be seen how a bucket 614' can be used as extra stabilizer on the front side.

FIG. 7 shows a seventh embodiment which is the same as the first embodiment, with the difference that a loading bucket 711 is coupled to operating arm 710, wherein the operating arm is in the folded position and therefore functions as a single lifting arm.

FIG. 8 shows an embodiment with steered front and rear wheels 804, 804'. FIG. 8 further illustrates how sub-frame 803 co-rotates in the steering direction of the front wheels. The skilled person will appreciate that this co-rotation can further depend on other variables in addition to the direction of the front wheels.

FIGS. 9A and 9B show a ninth embodiment in which an adapter is mounted on the quick change system. Such an adapter 930 allows the mounting of other attachments. Other attachments are for instance: attachments used mainly on skid steers, such as a driven snow shovel, a rotating brush, a dozer blade, a concrete mixer and so on.

According to a variant the machine has no adapter, but the attachments are then mounted via a separate quick change system.

Finally, FIG. 10 shows an embodiment with a normal digging arm 1010 with a first guide 1021 in the form of a curved arm.

FIGS. 11A to C illustrate the arrangement of the different components necessary for driving the wheels and the operating arm and possible other components such as the stabilizers, the power takeoff etc. in an embodiment of a mobile apparatus according to the invention. As shown in FIG. 11A, motor 1244 is arranged centrally in sub-frame 1203. Tanks 1241, 1242 are arranged on either side of motor 1244. Such a tank can for instance be intended for storing hydraulic oil or for storing fuel or for storing another liquid or gas. Motor 1244 is typically a combustion engine but can also be any other type of motor. One or more pumps 1240, typically liquid pumps, can further be provided in sub-frame 1203. A cooling element or radiator 1243 is also provided on the rear side of motor 1244. A feed 1245 rotatable through 360° for liquid and/or gas and/or electricity lines is provided between sub-frame 1203 and main frame 1202.

As best shown in FIGS. 11B and 11C, the motor is preferably mounted as low as possible in sub-frame 1203. A great stability is in this way obtained.

FIG. 12 illustrates another possible embodiment in which elements 1241 to 1244 are arranged at a determined angle compared to the embodiment of FIGS. 11A to C.

FIGS. 13A to C illustrate another variant for arranging the drive means in an embodiment of the mobile apparatus according to the invention. In this embodiment tanks 1341, 1342 are placed further forward and a cooling element 1343 and pumps 1340 are arranged on either side of motor 1344. Such an embodiment will once again result in a stable construction.

FIGS. 14A and B show an embodiment similar to that in FIGS. 13A to C, but for a hybrid drive. Tanks 1441 and 1442 are here liquid or gas tanks and, in addition to liquid pump 1440, an additional drive unit, for instance a generator unit 1447, is provided. Further provided is a storage capacity for electricity such as a battery 1446.

Figure 15B:
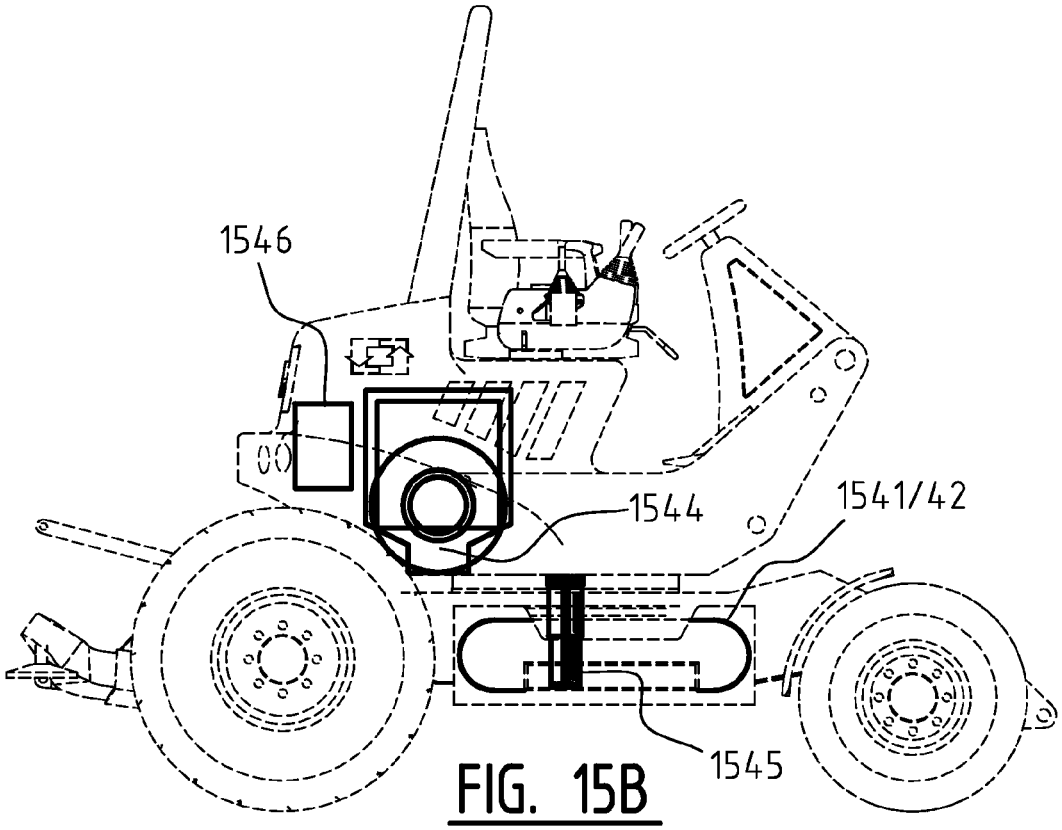
Figure 15C:
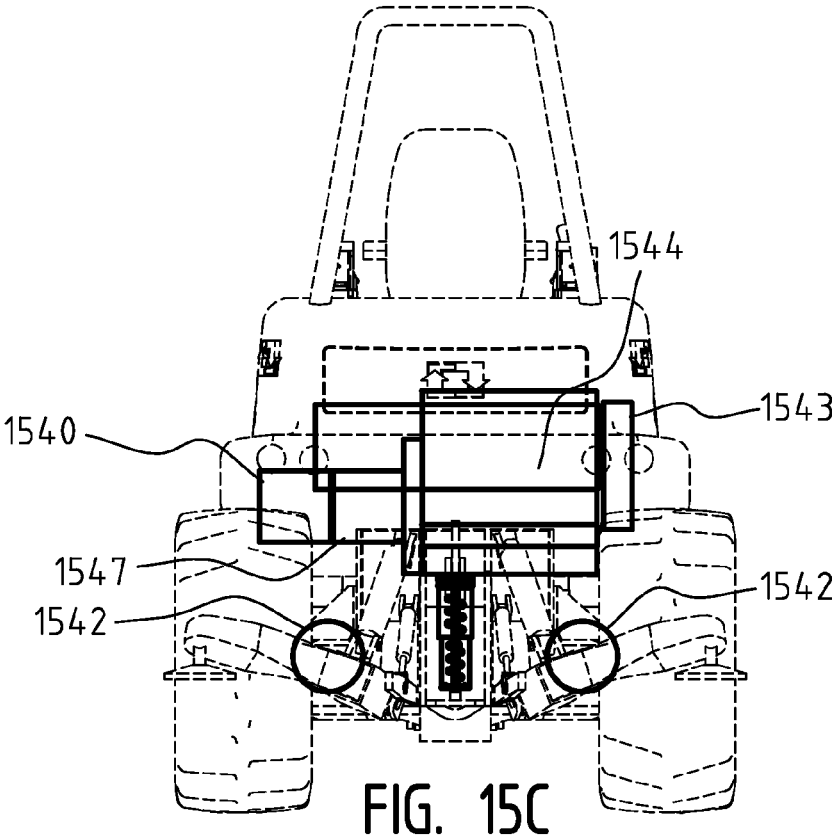

FIGS. 15A to C show a hybrid drive unit, the components of which are distributed over the sub-frame and the main frame. In the shown embodiment motor 1544 is arranged in the sub-frame, while tanks 1541 and 1542 are arranged in the main frame. Pump 1540, generator unit 1547 and the electricity storage capacity 1546 are further likewise accommodated in the sub-frame.

FIGS. 16A and B show an embodiment of a drive with a fuel cell in which the fuel cell is stored either centrally 1648 in the sub-frame or at the rear of sub-frame 1647. According to a variant on the electricity storage unit can be stored centrally 1648 or at the rear of sub-frame 1647. Tanks 1641, 1642 are once again provided in the main frame.

FIGS. 17A to C show yet another variant with fuel cell, wherein all the discussed components of the drive means are located in the sub-frame. The fuel cell unit or storage capacity unit 1748 is more particularly situated centrally in the sub-frame with a tank 1741, 1742 on either side thereof. The electricity storage capacity or fuel cell 1747 and cooling unit 1743 are further situated at the rear in the sub-frame.

FIGS. 18A to 18C show yet another variant with fuel cells and electricity storage unit, wherein these components are distributed over elements 1847, 1848 and 1849 and 1850. Units 1849 and 1850 are situated in the main frame, on two outer sides thereof. Unit 1848 is situated centrally in the sub-frame and unit 1847 is situated at the rear in the sub-frame.

According to another variant illustrated in FIGS. 19A to 19C, the mobile unit can be driven wholly electrically or wholly via fuel cells. In the embodiment of FIGS. 19A to 19C the components 1947, 1949, 1950 can all be electricity storage units or all fuel cell units. Units 1949, 1950 are situated in the main frame as far as possible toward the outside between the front and rear wheels. Unit 1947 is situated at the rear in the sub-frame.

Finally, FIGS. 20A and 20B show a further variant with one fuel cell 2048 and two electricity storage units 2049, 2050. Storage units 2049, 2050 are provided in the main frame, while fuel cell 2048 is provided in the sub-frame. Tank 2041, 2042 are further provided on either side of the centrally mounted fuel cell 2048. Finally, the sub-frame is provided at the rear with a cooling unit 2043.

FIGS. 21(A)-(E) further illustrate another important variant, wherein the larger wheels 2004 are provided at the front instead of at the rear, i.e. the side of the three-point lifting device 2013 in FIGS. 21(A)-(E). The small wheels 2004' are then provided at the rear. The other components of this embodiment resemble those of the embodiment of FIGS. 1(A)-(E) and will not be discussed again in detail here. Similar components are designated with the same reference numerals, with 2000 added.

Mobile apparatus 2001 has a rotatable sub-frame 2003 so that the driver/operator can select the travel direction or, in other words, can choose which side functions as front side in which as rear side. The driver can herein position the articulated arm or the single lifting arm 2010 on that side where it is most effective. The reason for opting to operate with large wheels 2004 at the front may for instance be to reduce the ground pressure. In determined cases this may moreover have the additional advantage that a greater steering angle of the steered wheels is thereby possible. At higher speeds of the mobile apparatus it may then be recommended to return the machine to the position with small wheels at the front.

Figure 21B:
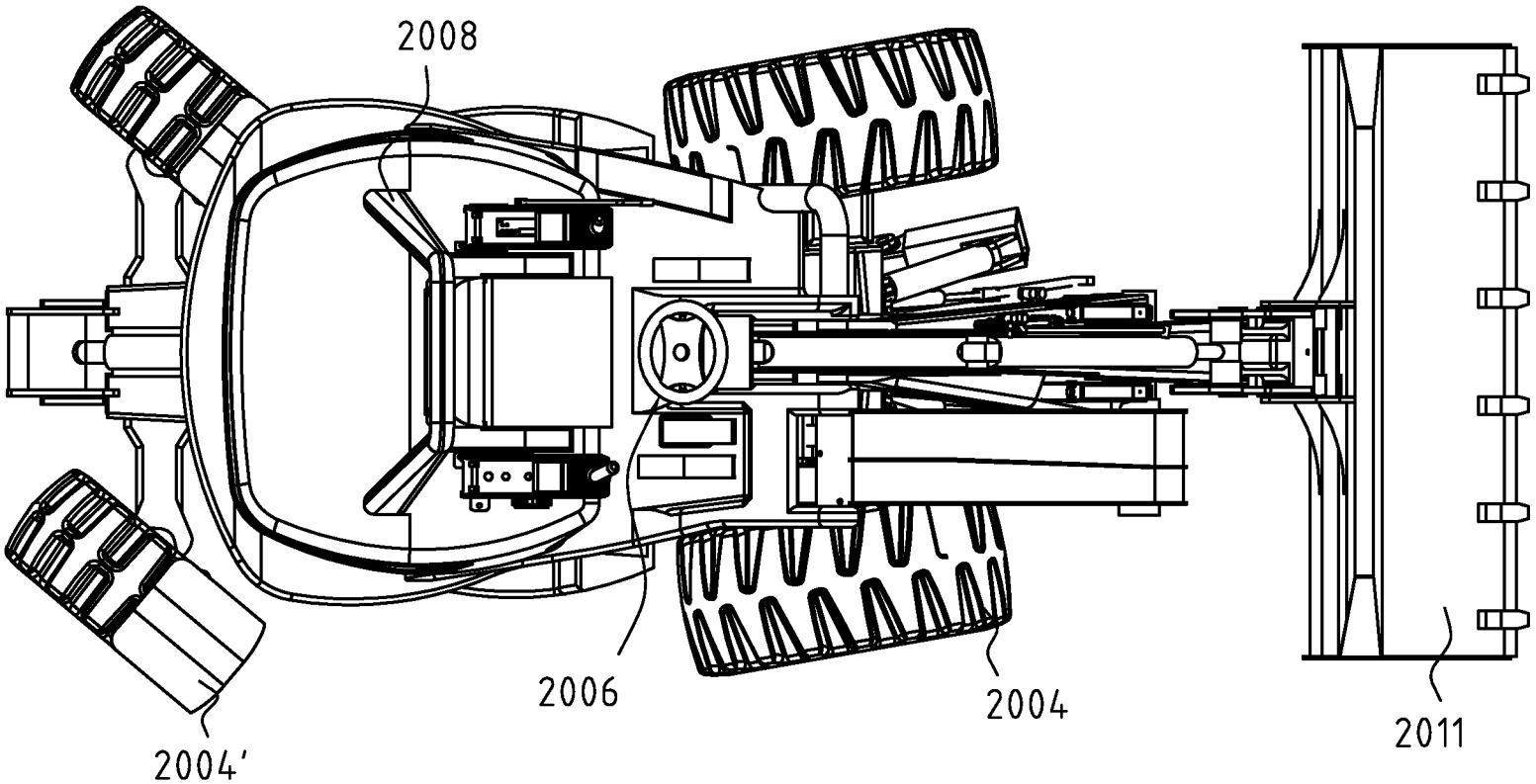

As illustrated in FIG. 21(B), the mobile apparatus can be embodied in accordance with a variant such that the most steered wheels, the small wheels 2004', are on the rear side. It is also possible—see FIG. 21(C)—that only the rear axle with small wheels 2004' is steered and that the front axle with large wheels 2004 is not steered.

Note that in yet another embodiment all wheels can be of the same size.

Figure 21C:
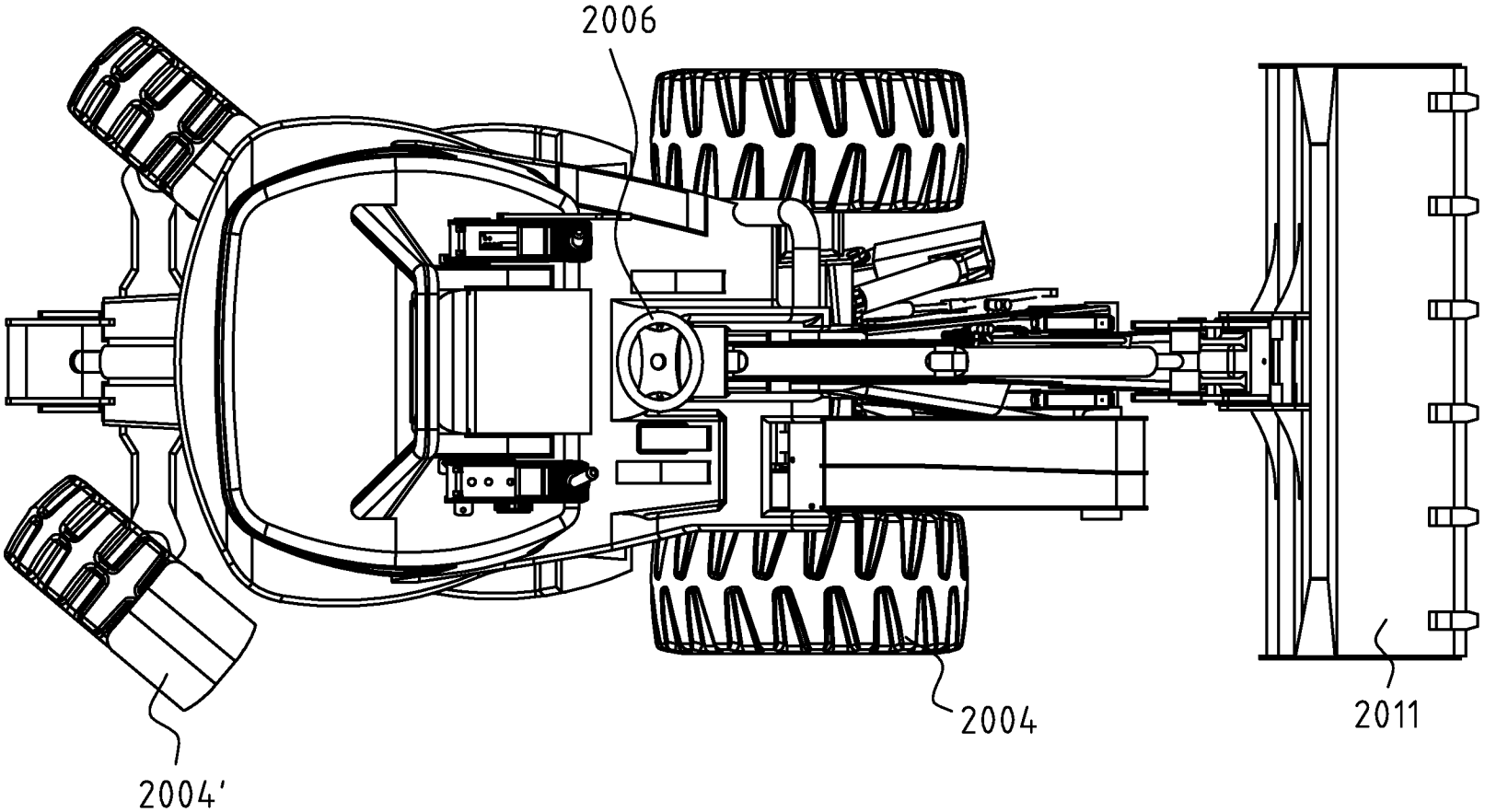
Figure 21D:
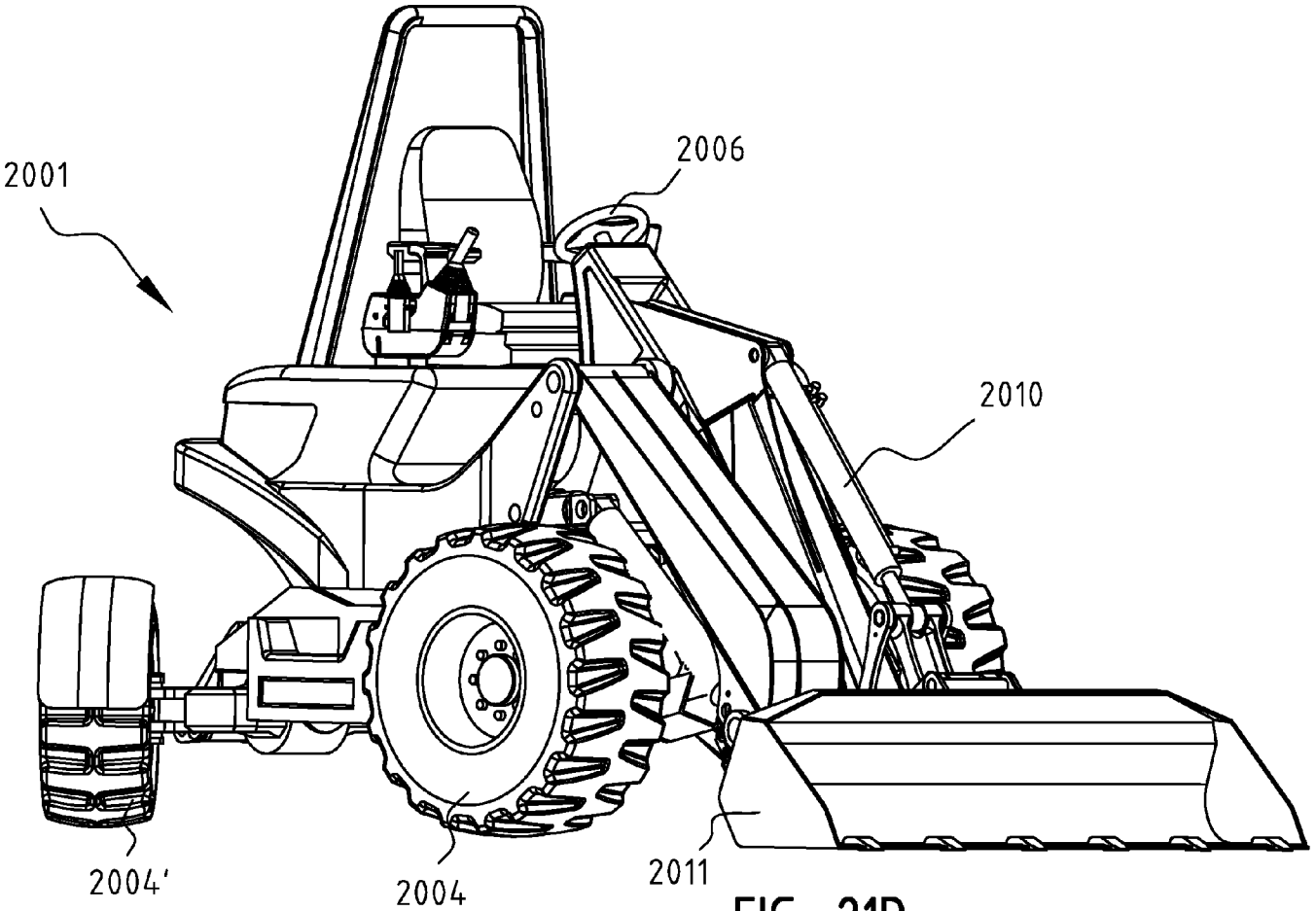
Figure 21E:
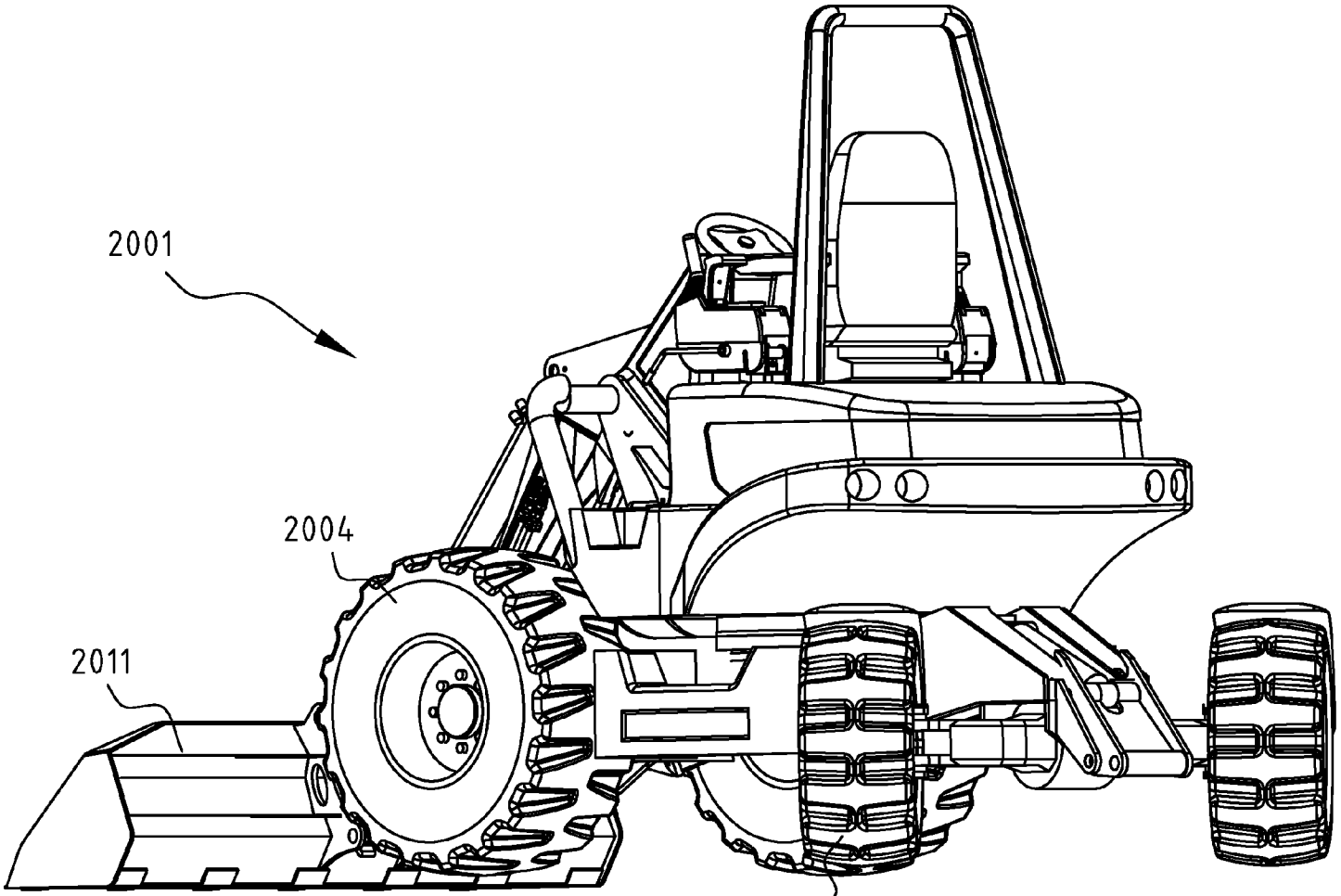

In order to ensure that the driver can choose between two possible travel directions, a switch is for instance provided which switches the steering wheel movement of all four wheels and/or of only the steered wheels (see for instance the variant of FIG. 21(C)). FIG. 25(A) shows schematically how this switch in travel direction, or of front and rear side, and so also of steering direction, can be realized. Shown in this figure is a steering wheel 2501 which is coupled to a technical device, for instance an orbit roll 2502, which converts the rotating steering signal into an electrical/pneumatic or hydraulic signal. This signal is for instance converted by a manipulator 2503, wherein manipulator 2503 is adjusted using a switch 2504. This switch 2504 is typically arranged close to the driver's seat or where the driver sits or stands. Single manipulator 2503 can for instance be an electric relay, but can also be a pneumatic or hydraulic steering slide or valve. This manipulator transmits the signal to an actuating member, here for instance a pneumatic or hydraulic cylinder 2505. This can for instance also be an electrically driven spindle which realizes the angular adjustment of the front wheels and/or the rear wheels.

In the shown situation switch 2504 is in the rest position. Here the travel direction is forward as indicated on the left in the figure, with the front side on the side of the small wheels. At a switch-over forward becomes reverse, and the front side thus becomes the side with the large wheels.

According to another embodiment variant, the steering wheel can be replaced by a joystick which will determine the steering angle of the wheels.

If the driver changes the travel direction via switch 2504, it is then almost essential in practice to switch operation of forward and reverse. The driver is after all accustomed to choosing between forward and reverse because there is a front and a rear side of the machine. If however these sides are switched, it is then recommended to also switch the operation of forward and reverse in order to avoid confusion.

FIG. 25(B) shows schematically how this switch-over is effected. In the prior art apparatus a switch between forward and reverse 2508 is typically provided in the vicinity of driver 2508. This switch 2508 is for instance on the right-hand joystick, or can be a foot pedal or even multiple foot pedals. This switch 2508 is likewise used to adjust manipulator 2503. If the travel direction, and so front side and rear side, are now reversed, the travel direction of the motor 2507 will then also be reversed via manipulator 2503. In this way switch 2508 thus continues to retain its function, and forward is the direction which at that moment is indicated as forward by switch 2504.

As illustrated in FIG. 22, it is likewise possible to position an attachment, such as for instance a mowing bar 2230, under the machine between the axles. In this way both the lifting device and the operating arm are still available. Similar components are designated with the same reference numerals as in FIGS. 1(A)-(E), wherein 2200 is added.

If the operating arm is used as loading bucket or other attachment such as a pallet fork 2311 (see FIG. 23) on the side of the large wheels, it is possible to place a counterweight 2314 in the quick change device 2329. An example is shown in FIG. 23, wherein similar components are designated with the same reference numerals as in FIGS. 1(A)-(E), wherein 2300 is added. In this position it is also possible to use a loading bucket 2414 as counterweight as illustrated in FIG. 24, wherein similar components are designated with the same reference numerals as in FIGS. 1(A)-(E), wherein 2400 is added. FIG. 24 also illustrates possible caterpillar tracks (2425) and mechanical legs (2426).

According to another embodiment variant (not shown), it is possible to mount a three-point lifting device only on the side of the small wheels, and in yet another embodiment variant it is possible to have a three-point lifting device at both the front and rear, wherein hydraulic conduits are available on each side for additional functions. This latter variant has the advantage that more attachments can be coupled simultaneously to the machine.

In another further developed embodiment variant it is possible to have the front wheels and the rear wheels operate on a narrower track. It hereby becomes possible to also drive on narrow paths, or for instance between fruit trees or in vineyards. The driver can then preferably choose between a normal width track or a narrower track. In another variant thereof it is possible to have the front axle operate at a track width other than the rear axle. The advantage is that in this way only one wheel drives over the ground surface, and less damage is therefore caused to the ground.

Finally, yet another variant consists of limiting the rotation of the sub-frame, or of fixing the sub-frame. This is possible with a mechanical or hydraulic or other type of brake or by a mechanical locking. This may for instance be useful in practice during mowing of verges or trimming of hedges. The mowing bar or hedge cutters are here fixed to the outer end of the articulated arm or the loading bucket arm. The machine then moves forward at a determined speed. If no rotation locking or brake is arranged, there is then the possibility that due to increased resistance of the attachment—in a direction opposite to the travel direction —the sub-frame will begin to rotate. This is then prevented by a brake or a locking on the rotation device of the sub-frame.

The skilled person will appreciate that the present invention is not limited to the above described exemplary embodiments, and that many variants can still be envisaged which fall within the scope of the invention, the scope being defined solely by the following claims.

The invention claimed is:

1. A mobile apparatus, the apparatus comprising a main frame displaceable on one or more displacing elements;

a sub-frame which is rotatable around a vertical axis and which is mounted on the main frame; said sub-frame comprising a driver's position, and a number of steering elements;

at least one operating arm mounted on the sub-frame;

an automatically movable lifting device provided on the main frame, which lifting device is adapted to be connectable to an agricultural attachment, said lifting device being controllable by an actuator;

a motor for driving at least the one or more displacing elements; and a power take-off coupled to the motor;

wherein the lifting device and the power take-off are provided on the same side of the main frame;

wherein the main frame is provided with one or more stabilizers configured for stabilizing the apparatus during the use of the at least one operating arm; and wherein a number of removable stabilizers of said one or more stabilizers are connectable to the lifting device such that the actuator of the lifting device can also function as an actuator for said number of removable stabilizers.

2. The mobile apparatus according to claim 1, wherein the at least one operating arm comprises a double arm for the attachment of a loading bucket.

3. The mobile apparatus according to claim 1, wherein the at least one operating arm comprises a telescopic arm.

4. The mobile apparatus according to claim 1, wherein the at least one operating arm is mounted on the sub-frame for pivoting around a horizontal axis.

5. The mobile apparatus according to claim 1, wherein the at least one operating arm is mounted on the sub-frame for pivoting around a vertical axis.

6. The mobile apparatus according to claim 1, wherein the one or more displacing elements are one of the following: wheels, caterpillar tracks, mechanical legs.

7. The mobile apparatus according to claim 6, wherein the mobile apparatus is provided with a pair of rear wheels and a pair of front wheels, which rear wheels are larger than the front wheels.

8. The mobile apparatus according to claim 1, wherein the center of gravity of the displaceable main frame lies lower than the top side of the one or more displacing elements, and that the sub-frame has an underside with a recess, the form of which is adapted to extend over the one or more displacing elements, this such that the lowest point of the sub-frame lies lower than the top side of the displacing means and that the sub-frame can rotate freely without making contact with the one or more displacing elements.

9. A mobile apparatus according to claim 1, wherein a control system is provided for automatically guiding the rotation of the sub-frame and/or the movement of the at least one operating arm as a function of the steering of the one or more displacing elements.

10. A mobile apparatus according to claim 1, wherein a control system is provided for automatically guiding the rotation of the sub-frame and/or the movement of the at least one operating arm such that the angle which the operating arm makes is the same as a steering wheel movement, or proportional to the steering wheel movement as a function of the travel speed of the machine apparatus.

11. A mobile apparatus according to claim 1, wherein the operating arm consists of at least three articulations connected pivotally to each other, wherein the last articulation of the operating arm has a greater length than the penultimate one such that the articulations can be folded against each other, and the arm can be transformed from an articulated arm to a single lifting arm.

12. A mobile apparatus according to claim 1, wherein the mobile apparatus is provided on a front side with a pair of front wheels and on a rear side with a pair of rear wheels, wherein the front wheels are larger than or as large as the rear wheels.

13. A mobile apparatus according to claim 1, wherein the mobile apparatus has a front side and a rear side, wherein the rear side is provided with a coupling system to which a counterweight comprising a loading bucket can be coupled.

14. A mobile apparatus according to claim 1, wherein the apparatus has a front side and rear side and a travel direction corresponding thereto, wherein the travel direction, and therefore also the front and rear sides, are reversible.

15. A mobile apparatus according to claim 1, the apparatus further comprising a switch configured to be operated by a driver for adjusting a travel direction of the mobile apparatus.

16. A mobile apparatus according to claim 15, wherein a signal manipulator is further provided, which signal manipulator is coupled to the switch and to the steering elements for moving the mobile apparatus in the travel direction set by the driver using the switch.

17. A mobile apparatus according to claim 16, wherein the mobile apparatus is provided with a forward/reverse switch, wherein the forward/reverse switch is likewise coupled to the signal manipulator for moving the mobile apparatus in the travel direction set by the driver using the switch, taking into account the position of the forward/reverse switch.

18. A mobile apparatus, the apparatus comprising a main frame displaceable on one or more displacing elements;

a sub-frame which is rotatable around a vertical axis and which is mounted on the main frame; said sub-frame comprising a driver's position, and a number of steering elements;

at least one operating arm mounted on the sub-frame;

an automatically movable lifting device provided on the main frame, which lifting device is adapted to be connectable to an agricultural attachment;

a motor for driving at least the one or more displacing elements; and a power take-off coupled to the motor;

wherein the lifting device and the power take-off are provided on the same side of the main frame;

wherein the displacing elements comprise a pair of rear wheels and a pair of front wheels;

wherein the center of gravity of the displaceable main frame lies lower than the top side of the rear wheels and the front wheels;

wherein the sub-frame has an underside, the form of which is configured to extend over the rear wheels and the front wheels, this such that the lowest point of the sub-frame lies lower than the top side of the rear wheels and that the sub-frame can rotate freely without making contact with the rear wheels or the front wheels; and wherein the displaceable main frame is situated substantially between the front and rear wheels.

* * * * *

UNITED STATES PATENT AND TRADEMARK OFFICE

CERTIFICATE OF CORRECTION

PATENT NO. : 9,017,006 B2
APPLICATION NO. : 13/002495
DATED : April 28, 2015
INVENTOR(S) : Leendert Wilhelmus C. Huissoon It is certified that error appears in the above-identified patent and that said Letters Patent is hereby corrected as shown below:

On the title page, please correct the typographical errors with the address of the inventor and the name of the Assignee so that they read:

"(75) Inventor: Leendert Wilhelmus Cornelis Huissoon, 's-Heer Arendskerke Zeeland (NL)

(73) Assignee: Hudson Bay Holding B.V., 's-Heer Arendskerke (NL)"

Signed and Sealed this
Third Day of November, 2015

Michelle K. Lee

Michelle K. Lee
*Director of the United States Patent and Trademark Office*